US007128154B2

(12) United States Patent
Giroux et al.

(10) Patent No.: US 7,128,154 B2
(45) Date of Patent: Oct. 31, 2006

(54) SINGLE-DIRECTION CEMENTING PLUG

(75) Inventors: Richard L. Giroux, Cypress, TX (US); David J. Brunnert, Houston, TX (US); Gregory Guy Galloway, Conroe, TX (US); John C. Jordan, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 173 days.

(21) Appl. No.: 10/767,322

(22) Filed: Jan. 29, 2004

(65) Prior Publication Data

US 2004/0251025 A1 Dec. 16, 2004

Related U.S. Application Data

(60) Provisional application No. 60/443,768, filed on Jan. 30, 2003.

(51) Int. Cl.
*E21B 33/13* (2006.01)

(52) U.S. Cl. ..... 166/291; 166/155

(58) Field of Classification Search ..... 166/291, 166/153, 155

See application file for complete search history.

(56) References Cited

U.S. PATENT DOCUMENTS

| | | | |
|---|---|---|---|
| 122,514 | A | 1/1872 | Bullock |
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,418,766 | A | 6/1922 | Wilson |
| 1,471,526 | A | 10/1923 | Pickin |
| 1,585,069 | A | 5/1926 | Youle |
| 1,728,136 | A | 9/1929 | Power |
| 1,777,592 | A | 10/1930 | Thomas |
| 1,825,026 | A | 9/1931 | Thomas |
| 1,830,625 | A | 11/1931 | Schrock |
| 1,842,638 | A | 1/1932 | Wigle |
| 1,851,289 | A | 3/1932 | Owen |
| 1,880,218 | A | 10/1932 | Simmons |
| 1,917,135 | A | 7/1933 | Littell |
| 1,981,525 | A | 11/1934 | Price |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |

(Continued)

FOREIGN PATENT DOCUMENTS

| | | |
|---|---|---|
| CA | 2 335 192 | 11/2001 |

(Continued)

OTHER PUBLICATIONS

U.K. Search Report, Application No. GB 0402133.3, dated Apr. 7, 2004.

(Continued)

*Primary Examiner*—William Neuder
(74) *Attorney, Agent, or Firm*—Patterson & Sheridan, LLP

(57) ABSTRACT

The present invention generally relates to apparatus and methods for completing a well. Particularly, the present invention relates to a single-direction plug for use with cementing applications and with drilling with casing applications. One embodiment comprises a cement plug for installation in a wellbore casing. The plug includes a body and gripping members for preventing movement of the body in a first axial direction relative to the casing. The plug further comprises a sealing member for sealing a fluid path between the body and the casing. The plug is movable in a second axial direction with fluid pressure but is not movable in the first direction due to fluid pressure.

34 Claims, 14 Drawing Sheets

U.S. PATENT DOCUMENTS

| | | | | | |
|---|---|---|---|---|---|
| 2,105,885 | A | | 1/1938 | Hinderliter | |
| 2,167,338 | A | | 7/1939 | Murcell | |
| 2,214,429 | A | | 9/1940 | Miller | |
| 2,216,895 | A | | 10/1940 | Stokes | |
| 2,228,503 | A | | 1/1941 | Boyd et al. | |
| 2,295,803 | A | | 9/1942 | O'Leary | |
| 2,305,062 | A | * | 12/1942 | Church et al. | 166/119 |
| 2,324,679 | A | | 7/1943 | Cox | |
| 2,370,832 | A | | 3/1945 | Baker | |
| 2,379,800 | A | | 7/1945 | Hare | |
| 2,383,453 | A | * | 8/1945 | Crickmer | 166/216 |
| 2,414,719 | A | | 1/1947 | Cloud | |
| 2,499,630 | A | | 3/1950 | Clark | |
| 2,522,444 | A | | 9/1950 | Grable | |
| 2,536,458 | A | | 1/1951 | Munsinger | |
| 2,572,309 | A | * | 10/1951 | Brown | 166/121 |
| 2,610,690 | A | | 9/1952 | Beatty | |
| 2,621,742 | A | | 12/1952 | Brown | |
| 2,627,891 | A | | 2/1953 | Clark | |
| 2,641,444 | A | | 6/1953 | Moon | |
| 2,650,314 | A | | 8/1953 | Hennigh et al. | |
| 2,663,073 | A | | 12/1953 | Bieber et al. | |
| 2,668,689 | A | | 2/1954 | Cormany | |
| 2,692,059 | A | | 10/1954 | Bolling, Jr. | |
| 2,720,267 | A | | 10/1955 | Brown | |
| 2,737,247 | A | * | 3/1956 | Baker et al. | 166/203 |
| 2,738,011 | A | | 3/1956 | Mabry | |
| 2,741,907 | A | | 4/1956 | Genender et al. | |
| 2,743,087 | A | | 4/1956 | Layne et al. | |
| 2,743,495 | A | | 5/1956 | Eklund | |
| 2,764,329 | A | | 9/1956 | Hampton | |
| 2,765,146 | A | | 10/1956 | Williams | |
| 2,805,043 | A | | 9/1957 | Williams | |
| 2,953,406 | A | | 9/1960 | Young | |
| 2,978,047 | A | | 4/1961 | DeVaan | |
| 3,006,415 | A | | 10/1961 | Burns et al. | |
| 3,041,901 | A | | 7/1962 | Knights | |
| 3,054,100 | A | | 9/1962 | Jones | |
| 3,087,546 | A | | 4/1963 | Wooley | |
| 3,090,031 | A | | 5/1963 | Lord | |
| 3,102,599 | A | | 9/1963 | Hillburn | |
| 3,111,179 | A | | 11/1963 | Albers et al. | |
| 3,117,636 | A | | 1/1964 | Wilcox et al. | |
| 3,122,811 | A | | 3/1964 | Gilreath | |
| 3,123,160 | A | | 3/1964 | Kammerer | |
| 3,124,023 | A | | 3/1964 | Marquis et al. | |
| 3,131,769 | A | | 5/1964 | Rochemont | |
| 3,159,219 | A | | 12/1964 | Scott | |
| 3,169,592 | A | | 2/1965 | Kammerer | |
| 3,191,677 | A | | 6/1965 | Kinley | |
| 3,191,680 | A | | 6/1965 | Vincent | |
| 3,193,116 | A | | 7/1965 | Kenneday et al. | |
| 3,353,599 | A | | 11/1967 | Swift | |
| 3,380,528 | A | | 4/1968 | Timmons | |
| 3,387,893 | A | | 6/1968 | Hoever | |
| 3,392,609 | A | | 7/1968 | Bartos | |
| 3,419,079 | A | | 12/1968 | Current | |
| 3,425,489 | A | * | 2/1969 | Brown | 166/129 |
| 3,477,527 | A | | 11/1969 | Koot | |
| 3,489,220 | A | | 1/1970 | Kinley | |
| 3,518,903 | A | | 7/1970 | Ham et al. | |
| 3,548,936 | A | | 12/1970 | Kilgore et al. | |
| 3,550,684 | A | | 12/1970 | Cubberly, Jr. | |
| 3,552,507 | A | | 1/1971 | Brown | |
| 3,552,508 | A | | 1/1971 | Brown | |
| 3,552,509 | A | | 1/1971 | Brown | |
| 3,552,510 | A | | 1/1971 | Brown | |
| 3,552,848 | A | | 1/1971 | Van Wagner | |
| 3,559,739 | A | | 2/1971 | Hutchison | |
| 3,566,505 | A | | 3/1971 | Martin | |
| 3,570,598 | A | | 3/1971 | Johnson | |
| 3,575,245 | A | | 4/1971 | Cordary et al. | |
| 3,602,302 | A | | 8/1971 | Kluth | |
| 3,603,411 | A | | 9/1971 | Link | |
| 3,603,412 | A | | 9/1971 | Kammerer, Jr. et al. | |
| 3,603,413 | A | | 9/1971 | Grill et al. | |
| 3,606,664 | A | | 9/1971 | Weiner | |
| 3,624,760 | A | | 11/1971 | Bodine | |
| 3,635,105 | A | | 1/1972 | Dickmann et al. | |
| 3,656,564 | A | | 4/1972 | Brown | |
| 3,662,842 | A | | 5/1972 | Bromell | |
| 3,669,190 | A | | 6/1972 | Sizer et al. | |
| 3,680,412 | A | | 8/1972 | Mayer et al. | |
| 3,691,624 | A | | 9/1972 | Kinley | |
| 3,691,825 | A | | 9/1972 | Dyer | |
| 3,692,126 | A | | 9/1972 | Rushing et al. | |
| 3,696,332 | A | | 10/1972 | Dickson, Jr. et al. | |
| 3,700,048 | A | | 10/1972 | Desmoulins | |
| 3,729,057 | A | | 4/1973 | Werner | |
| 3,746,330 | A | | 7/1973 | Taciuk | |
| 3,747,675 | A | | 7/1973 | Brown | |
| 3,760,894 | A | | 9/1973 | Pitifer | |
| 3,776,320 | A | | 12/1973 | Brown | |
| 3,776,991 | A | | 12/1973 | Marcus | |
| 3,785,196 | A | | 1/1974 | Kinley et al. | |
| 3,808,916 | A | | 5/1974 | Porter et al. | |
| 3,838,613 | A | | 10/1974 | Wilms | |
| 3,840,128 | A | | 10/1974 | Swoboda, Jr. et al. | |
| 3,848,684 | A | | 11/1974 | West | |
| 3,857,450 | A | | 12/1974 | Guier | |
| 3,870,114 | A | | 3/1975 | Pulk et al. | |
| 3,881,375 | A | | 5/1975 | Kelly | |
| 3,885,679 | A | | 5/1975 | Swoboda, Jr. et al. | |
| 3,901,331 | A | | 8/1975 | Djurovic | |
| 3,913,687 | A | | 10/1975 | Gyongyosi et al. | |
| 3,915,244 | A | | 10/1975 | Brown | |
| 3,934,660 | A | | 1/1976 | Nelson | |
| 3,945,444 | A | | 3/1976 | Knudson | |
| 3,947,009 | A | | 3/1976 | Nelmark | |
| 3,964,556 | A | | 6/1976 | Gearhart et al. | |
| 3,980,143 | A | | 9/1976 | Swartz et al. | |
| 4,049,066 | A | | 9/1977 | Richey | |
| 4,054,332 | A | | 10/1977 | Bryan, Jr. | |
| 4,054,426 | A | | 10/1977 | White | |
| 4,064,939 | A | | 12/1977 | Marquis | |
| 4,077,525 | A | | 3/1978 | Callegari et al. | |
| 4,082,144 | A | | 4/1978 | Marquis | |
| 4,083,405 | A | | 4/1978 | Shirley | |
| 4,085,808 | A | | 4/1978 | Kling | |
| 4,095,865 | A | | 6/1978 | Denison et al. | |
| 4,100,968 | A | | 7/1978 | Delano | |
| 4,100,981 | A | | 7/1978 | Chaffin | |
| 4,127,927 | A | | 12/1978 | Hauk et al. | |
| 4,133,396 | A | | 1/1979 | Tschirky | |
| 4,142,739 | A | | 3/1979 | Billingsley | |
| 4,153,109 | A | * | 5/1979 | Szescila | 166/382 |
| 4,173,457 | A | | 11/1979 | Smith | |
| 4,175,619 | A | | 11/1979 | Davis | |
| 4,186,628 | A | | 2/1980 | Bonnice | |
| 4,189,185 | A | | 2/1980 | Kammerer, Jr. et al. | |
| 4,194,383 | A | | 3/1980 | Huzyak | |
| 4,221,269 | A | | 9/1980 | Hudson | |
| 4,227,197 | A | | 10/1980 | Nimmo et al. | |
| 4,241,878 | A | | 12/1980 | Underwood | |
| 4,257,442 | A | | 3/1981 | Claycomb | |
| 4,262,693 | A | | 4/1981 | Giebeler | |
| 4,274,777 | A | | 6/1981 | Scaggs | |
| 4,274,778 | A | | 6/1981 | Putnam et al. | |
| 4,277,197 | A | | 7/1981 | Bingham | |
| 4,280,380 | A | | 7/1981 | Eshghy | |
| 4,281,722 | A | | 8/1981 | Tucker et al. | |
| 4,287,949 | A | | 9/1981 | Lindsey, Jr. | |
| 4,311,195 | A | | 1/1982 | Mullins, II | |
| 4,315,553 | A | | 2/1982 | Stallings | |

4,320,915 A 3/1982 Abbott et al.
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal
4,413,682 A 11/1983 Callihan et al.
4,427,063 A 1/1984 Skinner
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger et al.
5,074,366 A 12/1991 Karlsson et al.
5,082,069 A 1/1992 Seiler et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno 5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,433,279 A 7/1995 Tessari et al.
5,435,400 A 7/1995 Smith
5,437,340 A * 8/1995 Lee et al. ..... 175/61
5,452,923 A 9/1995 Smith
5,456,317 A 10/1995 Hood, III et al.
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.

6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,318,472 B1 * 11/2001 Rogers et al. ..... 166/382
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B1 3/2002 Quigley et al.
6,359,569 B1 3/2002 Beck et al.
6,360,633 B1 3/2002 Pietras
6,367,552 B1 4/2002 Scott et al.
6,367,566 B1 4/2002 Hill
6,371,203 B1 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B1 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,446,723 B1 9/2002 Ramos et al.
6,457,532 B1 10/2002 Simpson
6,458,471 B1 10/2002 Lovato et al.
6,464,004 B1 10/2002 Crawford et al.
6,464,011 B1 10/2002 Tubel
6,484,818 B1 11/2002 Alft et al.
6,497,280 B1 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B1 3/2003 Birckhead et al.
6,536,993 B1 3/2003 Strong et al.
6,538,576 B1 3/2003 Schultz et al.
6,540,025 B1 4/2003 Scott et al.
6,543,552 B1 4/2003 Melcalfe et al.
6,547,017 B1 4/2003 Vail, III
6,553,825 B1 4/2003 Boyd
6,554,064 B1 4/2003 Restarick et al.
6,585,040 B1 7/2003 Hanton et al.
6,591,471 B1 7/2003 Hollingsworth et al.
6,595,288 B1 7/2003 Mosing et al.
6,619,402 B1 9/2003 Amory et al.
6,622,796 B1 9/2003 Pietras
6,634,430 B1 10/2003 Dawson et al.
6,637,526 B1 10/2003 Juhasz et al.
6,648,075 B1 11/2003 Badrak et al.
6,651,737 B1 11/2003 Bouligny
6,655,460 B1 12/2003 Bailey et al.
6,666,274 B1 12/2003 Hughes
6,668,684 B1 12/2003 Allen et al.
6,668,937 B1 12/2003 Murray
6,679,333 B1 1/2004 York et al.
6,688,394 B1 2/2004 Ayling
6,688,398 B1 2/2004 Pietras
6,691,801 B1 2/2004 Juhasz et al.
6,698,595 B1 3/2004 Norell et al.
6,702,040 B1 3/2004 Sensenig
6,708,769 B1 3/2004 Haugen et al.
6,715,430 B1 4/2004 Choi et al.
6,719,071 B1 4/2004 Moyes
6,725,924 B1 4/2004 Davidson et al.
6,725,938 B1 4/2004 Pietras
6,732,822 B1 5/2004 Slack et al.
6,742,584 B1 6/2004 Appleton
6,742,596 B1 6/2004 Haugen
6,742,606 B1 6/2004 Melcalfe et al.
6,745,834 B1 6/2004 Davis et al.
6,752,211 B1 6/2004 Dewey et al.
6,832,658 B1 12/2004 Keast
6,837,313 B1 1/2005 Hosie et al.
6,840,322 B1 1/2005 Haynes
6,848,517 B1 2/2005 Wardley
6,854,533 B1 2/2005 Galloway
6,857,486 B1 2/2005 Chitwood et al.
6,857,487 B1 2/2005 Galloway et al.
2001/0000101 A1 4/2001 Lovato et al.
2001/0002626 A1 6/2001 Frank et al.
2001/0013412 A1 8/2001 Tubel
2001/0040054 A1 11/2001 Haugen et al.
2001/0042625 A1 11/2001 Appleton
2001/0047883 A1 12/2001 Hanton et al.
2002/0040787 A1 4/2002 Cook et al.
2002/0066556 A1 6/2002 Goode et al.
2002/0074127 A1 6/2002 Birckhead et al.
2002/0074132 A1 6/2002 Juhasz et al.
2002/0079102 A1 6/2002 Dewey et al.
2002/0108748 A1 8/2002 Keyes
2002/0134555 A1 9/2002 Allen et al.
2002/0157829 A1 10/2002 Davis et al.
2002/0162690 A1 11/2002 Hanton et al.
2002/0170720 A1 11/2002 Haugen
2002/0189806 A1 12/2002 Davidson et al.
2002/0189863 A1 12/2002 Wardley
2003/0029641 A1 2/2003 Meehan
2003/0034177 A1 2/2003 Chitwood et al.
2003/0056947 A1 3/2003 Cameron

| | | | | |
|---|---|---|---|---|
| 2003/0056991 | A1 | 3/2003 | Hahn et al. | |
| 2003/0070841 | A1 | 4/2003 | Merecka et al. | |
| 2003/0070842 | A1 | 4/2003 | Bailey et al. | |
| 2003/0111267 | A1 | 6/2003 | Pia | |
| 2003/0146023 | A1 | 8/2003 | Pia | |
| 2003/0164250 | A1 | 9/2003 | Wardley | |
| 2003/0164251 | A1 | 9/2003 | Tulloch | |
| 2003/0164276 | A1 | 9/2003 | Snider et al. | |
| 2003/0173073 | A1 | 9/2003 | Snider et al. | |
| 2003/0173090 | A1 | 9/2003 | Cook et al. | |
| 2003/0213598 | A1 | 11/2003 | Hughes | |
| 2003/0217865 | A1 | 11/2003 | Simpson et al. | |
| 2003/0221519 | A1 | 12/2003 | Haugen et al. | |
| 2004/0000405 | A1 | 1/2004 | Fournier, Jr. et al. | |
| 2004/0003490 | A1 | 1/2004 | Shahin et al. | |
| 2004/0003944 | A1 | 1/2004 | Vincent et al. | |
| 2004/0011534 | A1 | 1/2004 | Simonds et al. | |
| 2004/0016575 | A1 | 1/2004 | Shahin et al. | |
| 2004/0060697 | A1 | 4/2004 | Tilton et al. | |
| 2004/0065435 | A1* | 4/2004 | Tessier et al. | 166/153 |
| 2004/0069500 | A1 | 4/2004 | Haugen | |
| 2004/0069501 | A1 | 4/2004 | Haugen et al. | |
| 2004/0079533 | A1 | 4/2004 | Buytaert et al. | |
| 2004/0108142 | A1 | 6/2004 | Vail, III | |
| 2004/0112603 | A1 | 6/2004 | Galloway et al. | |
| 2004/0112646 | A1 | 6/2004 | Vail | |
| 2004/0118613 | A1 | 6/2004 | Vail | |
| 2004/0118614 | A1 | 6/2004 | Galloway et al. | |
| 2004/0123984 | A1 | 7/2004 | Vail | |
| 2004/0124010 | A1 | 7/2004 | Galloway et al. | |
| 2004/0124011 | A1 | 7/2004 | Gledhill et al. | |
| 2004/0124015 | A1 | 7/2004 | Vaile et al. | |
| 2004/0129456 | A1 | 7/2004 | Vail | |
| 2004/0140125 | A1 | 7/2004 | Vail | |
| 2004/0141111 | A1 | 7/2004 | Pia | |
| 2004/0144547 | A1 | 7/2004 | Koithan et al. | |
| 2004/0173358 | A1 | 9/2004 | Haugen | |
| 2004/0216892 | A1 | 11/2004 | Giroux et al. | |
| 2004/0216924 | A1 | 11/2004 | Pietras et al. | |
| 2004/0216925 | A1 | 11/2004 | Metcalf et al. | |
| 2004/0221997 | A1 | 11/2004 | Giroux et al. | |
| 2004/0226751 | A1 | 11/2004 | McKay et al. | |
| 2004/0244992 | A1 | 12/2004 | Carter et al. | |
| 2004/0245020 | A1 | 12/2004 | Giroux et al. | |
| 2004/0251025 | A1 | 12/2004 | Giroux et al. | |
| 2004/0251050 | A1 | 12/2004 | Shahin et al. | |
| 2004/0251055 | A1 | 12/2004 | Shahin et al. | |
| 2004/0262013 | A1 | 12/2004 | Tilton et al. | |
| 2005/0000691 | A1 | 1/2005 | Giroux et al. | |
| 2005/0096846 | A1 | 5/2005 | Koithan et al. | |

FOREIGN PATENT DOCUMENTS

| | | |
|---|---|---|
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |
| GB | 2 201 912 | 9/1988 |
| GB | 2 216 926 | 10/1989 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 345 074 | 6/2000 |
| GB | 2 348 223 | 9/2000 |
| GB | 2347445 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 382 361 | 5/2003 |
| GB | 2381809 | 5/2003 |
| GB | 2 386 626 | 9/2003 |
| GB | 2 389 130 | 12/2003 |
| RU | 112631 | 1/1956 |
| RU | 659260 | 4/1967 |
| RU | 247 162 | 5/1967 |
| RU | 395557 | 12/1971 |
| RU | 415346 | 3/1972 |
| RU | 481689 | 6/1972 |
| RU | 461218 | 4/1973 |
| RU | 501139 | 12/1973 |
| RU | 585266 | 7/1974 |
| RU | 583278 | 8/1974 |
| RU | 601390 | 1/1976 |
| RU | 581238 | 2/1976 |
| RU | 655843 | 3/1977 |
| RU | 781312 | 3/1978 |
| RU | 899820 | 6/1979 |
| RU | 955765 | 2/1981 |
| RU | 1304470 | 8/1984 |
| RU | SU 1618870 | 1/1991 |
| RU | 1808972 | 5/1991 |
| SU | 2 079 633 | 5/1997 |
| WO | WO 90/06418 | 6/1990 |

| | | |
|---|---|---|
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/24728 | 12/1993 |
| WO | WO 95/10686 | 4/1995 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 98/01851 | 1/1998 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/04135 | 1/1999 |
| WO | WO 99/11902 | 3/1999 |
| WO | WO 99/23354 | 5/1999 |
| WO | WO 99/24689 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | 11/1999 |
| WO | WO 99/64713 | 12/1999 |
| WO | WO 00/04269 | 1/2000 |
| WO | WO 00/05483 | 2/2000 |
| WO | WO 00/08293 | 2/2000 |
| WO | WO 00/09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/39429 | 7/2000 |
| WO | WO 00/39430 | 7/2000 |
| WO | WO 00/41487 | 7/2000 |
| WO | WO 00/46484 | 8/2000 |
| WO | WO 00/50730 | 8/2000 |
| WO | WO 00/66879 | 11/2000 |
| WO | WO 01/12946 | 2/2001 |
| WO | WO 01/46550 | 6/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/14649 | 2/2002 |
| WO | WO 02/44601 | 6/2002 |
| WO | WO 02/081863 | 10/2002 |
| WO | WO 02/086287 | 10/2002 |
| WO | WO 03/006790 | 1/2003 |
| WO | WO 03/074836 | 9/2003 |
| WO | WO 03087525 | 10/2003 |
| WO | WO 2004/022903 | 3/2004 |

OTHER PUBLICATIONS

Hahn, et al., "Simultaneous Drill and Case Technology—Case Histories, Status and Options for Further Development, " Society of Petroleum Engineers, IADC/SPE Drilling Conference, New Orlean, LA Feb. 23-25, 2000 pp. 1-9.
M.B. Stone and J. Smith, "Expandable Tubulars and Casing Drilling are Options" Drilling Contractor, Jan./Feb. 2002, pp. 52.
M. Gelfgat, "Retractable Bits Development and Application" Transactions of the ASME, vol. 120, Jun. (1998), pp. 124-130.
"First Success with Casing-Drilling" World Oil, Feb. (1999), pp. 25.
Dean E. Gaddy, Editor, "Russia Shares Technical Know-How with U.S." Oil & Gas Journal, Mar. (1999), pp. 51-52 and 54-56.
U.S. Appl. No. 10,794,800, filed Mar. 5, 2004.
U.S. Appl. No. 10/832,804, filed Apr. 27, 2004.
U.S. Appl. No. 10/795,214, filed Mar. 5, 2004.
U.S. Appl. No. 10/794,795, filed Mar. 5, 2004.
U.S. Appl. No. 10/775,048, filed Feb. 9, 2004.
U.S. Appl. No. 10/772,217, filed Feb. 2, 2004.
U.S. Appl. No. 10/788,976, filed Feb. 27, 2004.
U.S. Appl. No. 10/794,797, filed Mar. 5, 2004.
U.S. Appl. No. 10/767,322, filed Jan. 29, 2004.
U.S. Appl. No. 10/795,129, filed Mar. 5, 2004.
U.S. Appl. No. 10/794,790, filed mar. 5, 2004.
U.S. Appl. No. 10/162,302, filed Jun. 4, 2004.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
U.S. Appl. 10/618,093, filed Jul. 11, 2003, Boyle.
U.S. Appl. 10/189,570, filed Jul. 6, 2002, Vail.
Tarr, et al., "Casing-while-Drillin: The Next Step Change in Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs by 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technolgy, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs by 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., Hydraulic Rig Supports Casing Drilling, World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.

Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
Worlds's First Drilling With Casing Operation From A Floating Drilling unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfield, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al., "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing and Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System, " IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the-Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-while Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, AFC Industries, Catalog 80, 1980, 5 Pages.
Canrig Top Drive Drilling Systems, Harts Petroleum Engineer International, Feb. 1997, 2 pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 to 650 ECIS Top Drive, Advanced Permanent Magnet Motor Technology, TESCO Drilling Technology, Apr. 1998, 2 Pages.
500 or 950 HCIS Top Drive, Powerful Hydraulic Compact Top Drive Drilling System, TESCO Drilling Technology, Apr. 1998, 2 Pages.
Production Information (Sections 1-10) CANRIG Drilling Technology, LTD., Sep. 18, 1996.
Alexander Sas-Jaworsky and J. G. Williams, Development of Composite Coiled Tubing For Oilfield Services, SPE 26536, Society of Petroleum Engineers, Inc., 1993.
A. S. Jafar, H.H. Al-Attar, and I.S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M.S. Fuller, M. Littler, and I. Pollock, Innovative Way To Cement a Liner Utilizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev m. ring, patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 1000.
Kenneth K. Dupal, Donald B. Campo, John E. Lofton, Don Weisinger, R. lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Uisng Expandable Solid Tubulars To Solve Well Construction Challenges in Deep Waters and Maturing Properities, IBP 27500, Brazilian Petroleum Institute—IBP, 2000.
Coiled Tubing Handbook, World Oil, Gulf Publishing Company, 1993.
U.K Examination Report, Application No. GB 0402133.3, dated Jan. 16, 2006.

* cited by examiner

SINGLE-DIRECTION CEMENTING PLUG

CROSS-REFERENCE TO RELATED APPLICATIONS

This application claims benefit of U.S. Provisional Patent Application Ser. No. 60/443,768, filed Jan. 30, 2003, which application is herein incorporated by reference in its entirety.

BACKGROUND OF THE INVENTION

1. Field of the Invention

The present invention generally relates to apparatus and methods for completing a well. Particularly, the present invention relates to positioning a plug in a wellbore. More particularly, the present invention relates to a single-direction plug for use in well completions and drilling with casing applications.

2. Description of the Related Art

In the oil and gas producing industry, the process of cementing casing into the wellbore of an oil or gas well generally comprises several steps. For example, a string of casing is run in a wellbore to the required depth. Then, cement slurry is pumped into the casing to fill an annulus between the casing and the wellbore wall to a desired height. A displacement medium, such as a drilling or circulation fluid, is pumped behind the cement in order to urge the cement to exit the inside of the casing and enter the annulus. The cement slurry is typically separated from the circulation fluid by at least one cementing plug. Due to the difference in specific gravity between the circulating fluid and the cement slurry, the heavier cement slurry initially drops inside the casing without being pumped by hydrostatic pressure. After the height of cement slurry column outside the casing equals the height of the cement slurry column inside the casing, hydrostatic pressure must be exerted on the displacement fluid to force the rest of cement slurry out of the casing and into the annulus.

After the desired amount of cement slurry has been pumped into the annulus, it is desirable to prevent the backflow of cement slurry into the casing until the cement slurry sets and hardens. This backflow is created by the difference in specific gravity of the heavier cement and the generally lighter displacement fluid. One method for preventing the backflow of cement slurry into the casing involves holding constant the hydrostatic pressure on the displacement fluid in the casing until the cement slurry sets and hardens. This method, however, expands the casing and creates non-adherence of the casing to the hardened cement after the hydrostatic pressure in the casing is released and the casing string contracts. Another method of preventing the backflow of cement slurry involves placing a check valve in the lower end of the casing string to prevent the backflow of the cement slurry into the casing. The check valve may be run on a conventional casing string or pumped down the casing and latched into a float collar with a recess near the bottom of the casing string. Then, the cement slurry is pumped through the check valve. One problem with the use of a check valve in preventing the backflow of cement slurry is that flowing a cement slurry or other fluid through the check valve may damage the check valve and may prevent the check valve from functioning properly. In addition, installing a check valve, even in the open position, on a lower portion of a casing string can cause a pressure surge within the wellbore, thereby damaging surrounding hydrocarbon-bearing formations.

Recently, drilling with casing has become popular as a time saving way to complete a well. Drilling with casing involves using a casing string as a drill string to form a borehole and then using the same string to line the wellbore. Typically, a cutting member is placed at the lower end of the string and is later either retrieved or destroyed by subsequent drilling of another section of wellbore. One challenge of drilling with casing is providing a cementing apparatus in the string to facilitate the circulation of cement after the wellbore is formed. As described above, some type of one-way valve is typically used. However, because drilling fluid must be circulated through the string as the wellbore is formed, any valve in the string can hamper the circulation of fluid that is necessary for drilling Therefore, a need exists for an improved cementing apparatus for use in completing wells. There is a further need for an improved method of positioning a plug in a wellbore. There is also a need for a downhole tool capable of positioning at a desired depth in the wellbore.

SUMMARY OF THE INVENTION

The present invention generally relates to apparatus and methods for completing a well. Particularly, the present invention relates to a single-direction cementing plug for use with conventional well completions and with drilling with casing applications. One embodiment comprises a cement plug for installation in wellbore casing. The plug includes a body and gripping members for preventing movement of the body in a first axial direction relative to the casing. The plug further comprises a sealing member for sealing a fluid path between the body and the casing. The plug is movable in a second axial direction with fluid pressure but is not movable in the first direction due to fluid pressure.

In another aspect, the present invention provides a method of completing a wellbore. The method includes positioning a tubular in the wellbore and disposing a one-way traveling plug in the tubular. Thereafter, the one-way traveling plug may engage the tubular using a gripping member. The method also includes locating cement in an annular area between the tubular and the wellbore. In one embodiment, the tubular comprises a casing.

In another aspect, the present invention provides a cementing plug for cementing a tubular in a wellbore. The plug includes a body and one or more gripping members, wherein the gripping members, when actuated, prevent movement of the body in a first axial direction relative to the tubular, and, when not actuated, allow movement of the body in a second axial direction relative to the tubular.

In another aspect still, the present invention provides a plug for installation in a casing. The plug includes a body and one or more selectively actuatable gripping members for positioning the plug in the wellbore, wherein the one or more gripping members grip the casing to prevent movement of the plug in a first axial direction relative to the casing but allow movement of the plug in a second axial direction relative to the casing.

In another aspect still, the present invention provides a method of installing a cement plug in a casing to cement the casing in a wellbore. The method includes running the casing into the wellbore. Thereafter, a cement plug having a body and a gripping member for preventing axial movement of the body is disposed in the casing. At the desired location, the gripping members are activated to prevent the plug from moving axially.

In another aspect still, the present invention provides a method of positioning a tool in a fluid conduit. The method includes disposing the tool in the fluid conduit and urging the tool, having one or more gripping members, in a first direction in the fluid conduit. Thereafter, the tool is caused to engage a wall of the fluid conduit at a desired location using the one or more gripping members of the tool, thereby preventing movement of the tool in a second direction within the fluid conduit. Preferably, the fluid conduit comprises a hydrocarbon conduit such as a wellbore or a pipeline. In one embodiment, the tool comprises a downhole tool. In another aspect, the tool may be used to separate two fluid bodies in the fluid conduit. Exemplary fluid bodies include cement, drilling fluid, or hydrocarbon.

Another embodiment comprises a method of installing a cement plug in a well. The method includes running a string of wellbore casing into a wellbore. Then, a quantity of cement is injected into the casing in an amount adequate to fill a predetermined annular volume between the casing and the wellbore therearound. Then, the cement plug is installed at an upper end of the casing. The cement plug includes a body and gripping members for preventing movement of the body towards a surface of the well. The cement plug further includes a sealing member for sealing a fluid path between the body and the casing. Then, the plug is urged downwards to a desired depth in the wellbore with a second fluid. The plug separates the cement therebelow from the second fluid injected above the plug. Then, the gripping members are caused to set, thereby preventing the movement of the plug towards the surface of the well.

Yet another embodiment comprises a method of installing a cement plug in a well. The method includes drilling a wellbore with a string of casing having a cutting member disposed on a lower portion of the string. Then, a quantity of cement is injected into the casing in an amount adequate to fill a predetermined annular volume between the casing and the wellbore therearound. Then, the cement plug is installed at an upper end of the casing. The cement plug includes a body and gripping members for preventing movement of the body towards a surface of the well. The cement plug further includes a sealing member for sealing a fluid path between the body and the casing. Thereafter, the plug is urged downwards to a desired depth in the wellbore with a second fluid. The plug separates the cement therebelow from the second fluid injected above the plug. Then, the gripping members are caused to set, thereby preventing the movement of the plug towards the surface of the well.

BRIEF DESCRIPTION OF THE DRAWINGS

So that the manner in which the above recited features of the present invention, as well as other features set forth herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention generally relates to apparatus and methods for completing a well. Particularly, the present invention relates to a single-direction cementing plug.

Figure 1:
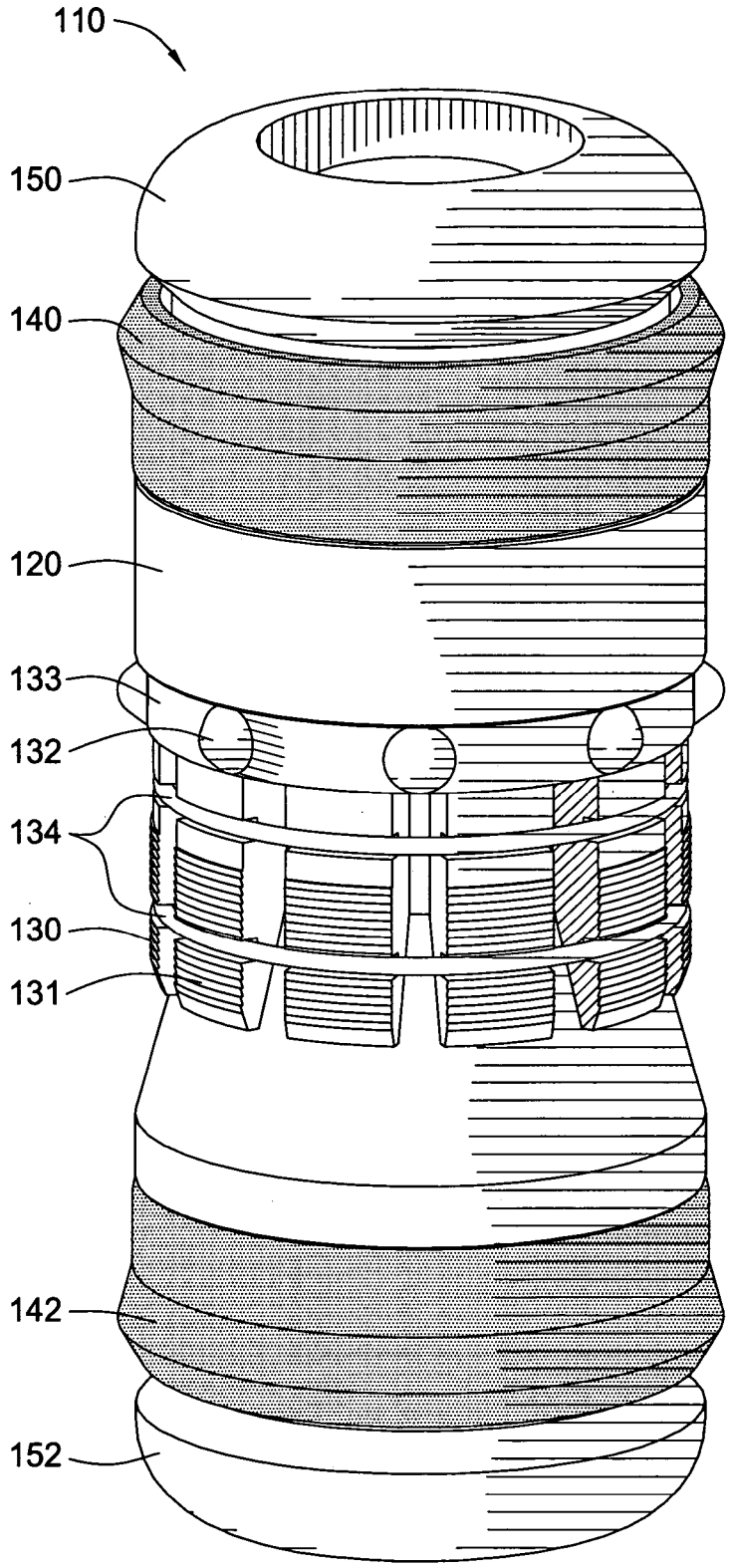
FIG. 1 is a schematic perspective view of one embodiment of a single-direction plug.
Figure 2:
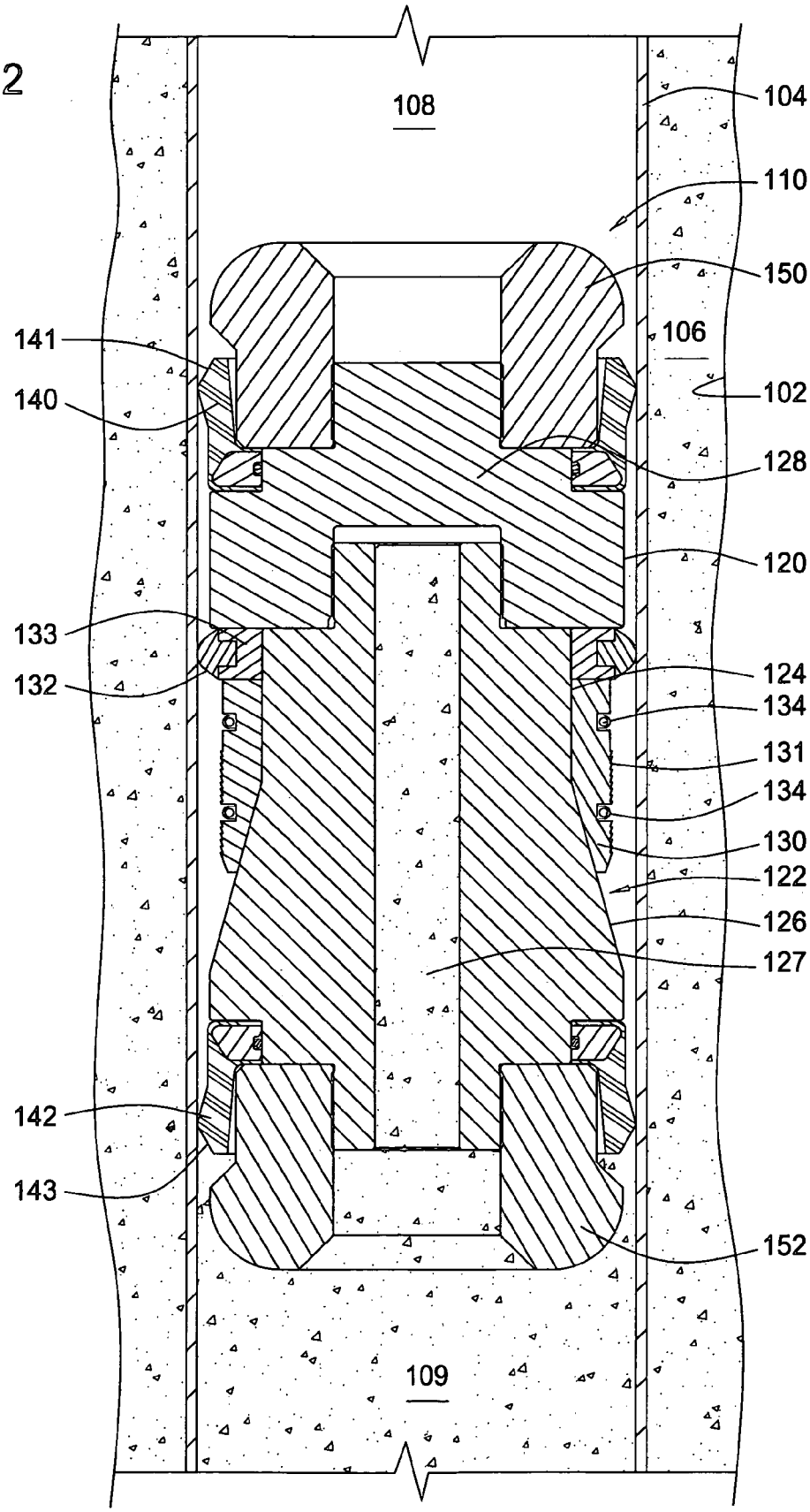
FIG. 2 is a schematic cross-sectional view of the single-direction plug of FIG. 1 in an unactuated position.

FIG. 1 is a schematic perspective view of one embodiment of a single-direction plug 110. The single-direction plug 110 may include a cylindrical body 120, one or more gripping members 130, a garter spring 134, a drag element 132, sealing members 140, 142, and end caps 150, 152. FIG. 2 is a schematic cross-sectional view of the single-direction plug 110 of FIG. 1 in an unactuated position disposed within a casing 104 lining a portion of a vertical wellbore 102. The annulus 106 between the casing 104 and the wellbore 102 is typically filled with a fluid, such as a cement slurry, to strengthen the walls of the wellbore and facilitate isolation of certain areas of the wellbore. The plug 110 may separate a first fluid 109, such as a cement slurry, from a second fluid 108, such as a displacement fluid, within the casing 104. The plug 110 is described in greater detail below using terms designating orientation. These terms designating orientation are only used for clarity reasons in reference to the vertical wellbore 102 and should not be deemed to limit the scope of the present invention. In other embodiments, the plug 110 may be disposed in a non-vertical wellbore, such as a horizontal wellbore.

The cylindrical body 120 of the plug 110 includes a bore 127 therethrough and a seal 128 to prevent the flow of fluid through the bore 127 and the body 120. A top end cap 150 may be coupled to the top end of the body 120 and a bottom end cap 152 may be coupled to the bottom end of the body 120. The end caps 150, 152 may comprise a rounded surface to help direct the plug 110 through the casing 104.

A top sealing member 140 may be coupled to the top end of the body 120, and a bottom sealing member 142 may be coupled to the bottom end of the body 120. The sealing members 140, 142 comprise lips 141, 143 which make movable contact with the inner walls of the casing 104. The lip 141 of the top sealing member 140 is directed upward to help isolate the second fluid 108 above the plug 110 while the lip 143 of the bottom sealing member 142 is directed downward to help isolate the first fluid 109 below the plug 110. The lips 141, 143 of the sealing members 140, 142 preferably comprise an elastic material. As shown in the figure, the body 120 comprises two pieces. In other embodiments, the body 120 may comprise one integral piece or three or more separate pieces.

The body 120 of the plug 110 further comprises a sloped portion 122 having a narrow region 124 above a wide region 126. The gripping members 130 are at least partially disposed around the sloped portion 122 of the body 120 and are moveable axially between the narrow region 124 and the wide region 126 of the sloped portion 122 of the body 120. The gripping members 130 may comprise multiple components as shown in FIG. 1. Referring again to FIG. 2, one or more garter springs 134 are disposed around the gripping members 130 to bias the gripping members 130 against the body 120.

The gripping members 130 are disposed proximate to the drag element 132. In the figure, the drag element 132 comprises drag buttons disposed on a slideable ring 133. Other types of drag elements 132 may also be used. As shown, the gripping members 130 are not attached to the drag element 132. In other embodiments, the gripping members 130 may be attached to the drag element 132. As the plug 110 is directed down the wellbore 102, the drag element 132 drags against the inner walls of the casing 104 and urges the slideable ring 133 upward relative to the body 120. The garter spring 134 biases the gripping members 130 against the body 120, and biases the gripping members 130 upward relative to the body 120 toward the slideable ring 133. Since the slideable ring 133 and the gripping members 130 are urged upward, the gripping members 130 are at the narrow region 124 of the sloped portion 122 of the body 120 and are prevented from making contact with the inner walls of the casing 104. In other words, the gripping members 130 are in a retracted position, and, thus, do not hinder downward movement of the plug 110 through the casing 104.

Figure 3:
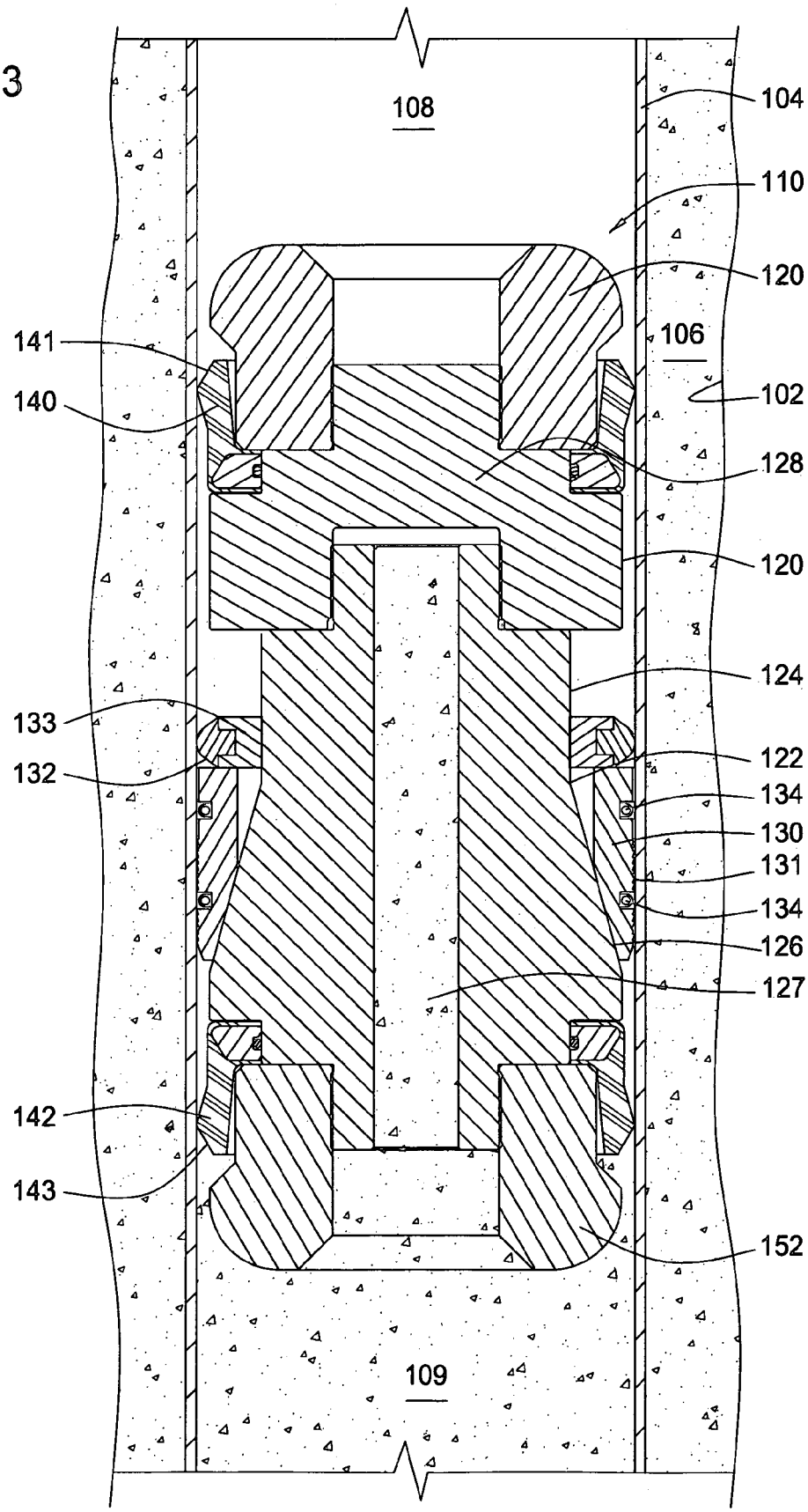
FIG. 3 is a schematic cross-sectional view of the single-direction plug of FIG. 1 in an actuated position.

FIG. 3 is a schematic cross-sectional view of the single-direction plug 110 of FIG. 2 in an actuated position. In one aspect, the plug 110 is actuated by causing the pressure below the plug 110 to be greater than the pressure above the plug 110, thereby forcing the plug 110 to move up the casing 104. As the plug 110 is directed up the casing 104, the drag element 132 drags against the inner walls of the casing 104 and urges the slideable ring 133 downward relative to the body 120. The slideable ring 133 contacts the gripping members 130 and moves the gripping members 130 downward relative to the body 120 against the bias of the garter spring 134. As a consequence, the gripping members 130 are urged to the wide region 126 of the sloped portion 122 of the body 120. Due to the larger outer diameter of the wide region 126, the gripping members 130 are forced outward against the bias of the garter springs 134, thereby contacting the inner walls of the casing 104. In this respect, the gripping members 130 may become wedged between the inner wall of the casing 104 and the body 120, thereby preventing upward movement of the plug 110. In another aspect, the gripping members 130 may further comprise gripping elements 131, such as teeth, bumps, or other irregular, non-smooth, or jagged surfaces, to facilitate engagement of the gripping members 130 with the casing 104, and to help prevent movement of the plug 110. In another embodiment, the gripping members may comprise a spring-loaded hydraulic anchor, as disclosed in U.S. Pat. No. 3,131,769, to de Rochemont, which patent is herein incorporated by reference in its entirety.

Figure 4:
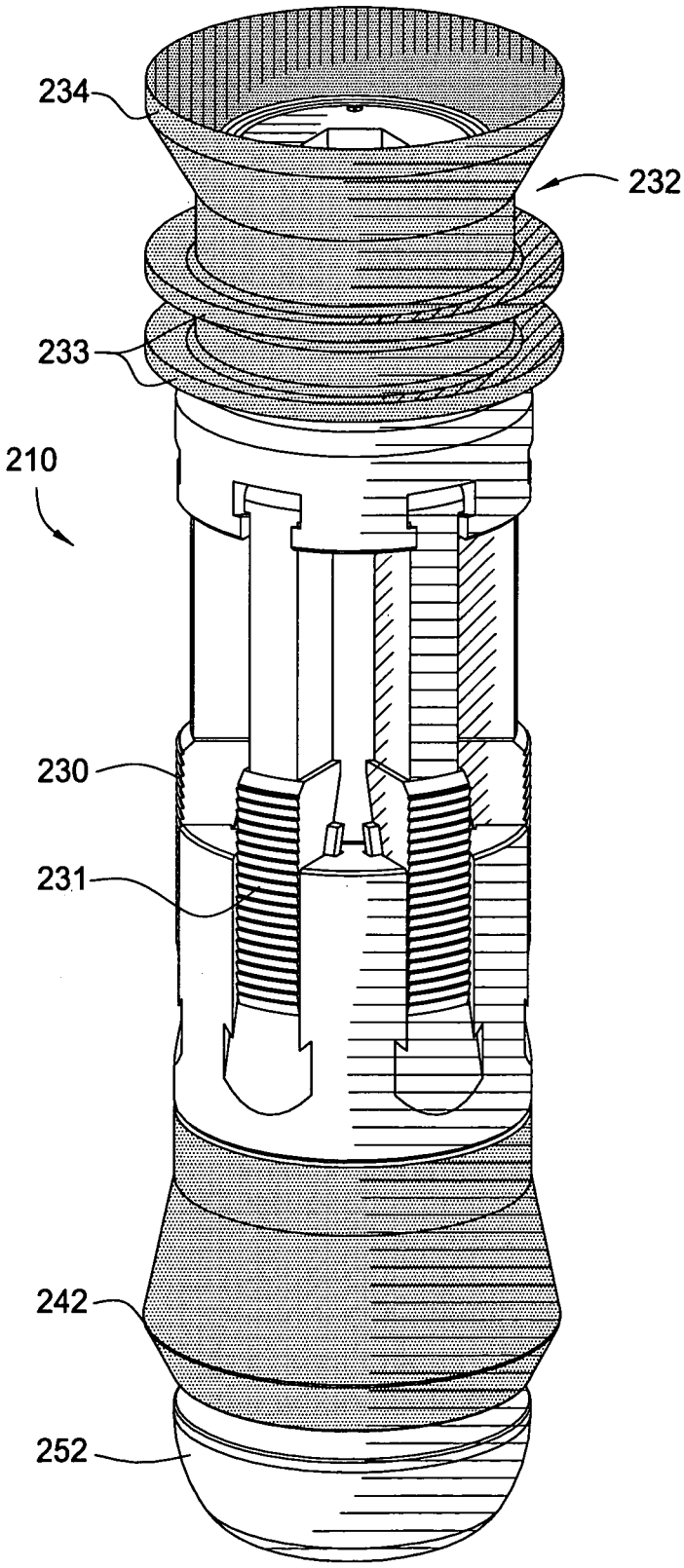
FIG. 4 is a schematic perspective view of another embodiment of a single-direction plug.
Figure 5:
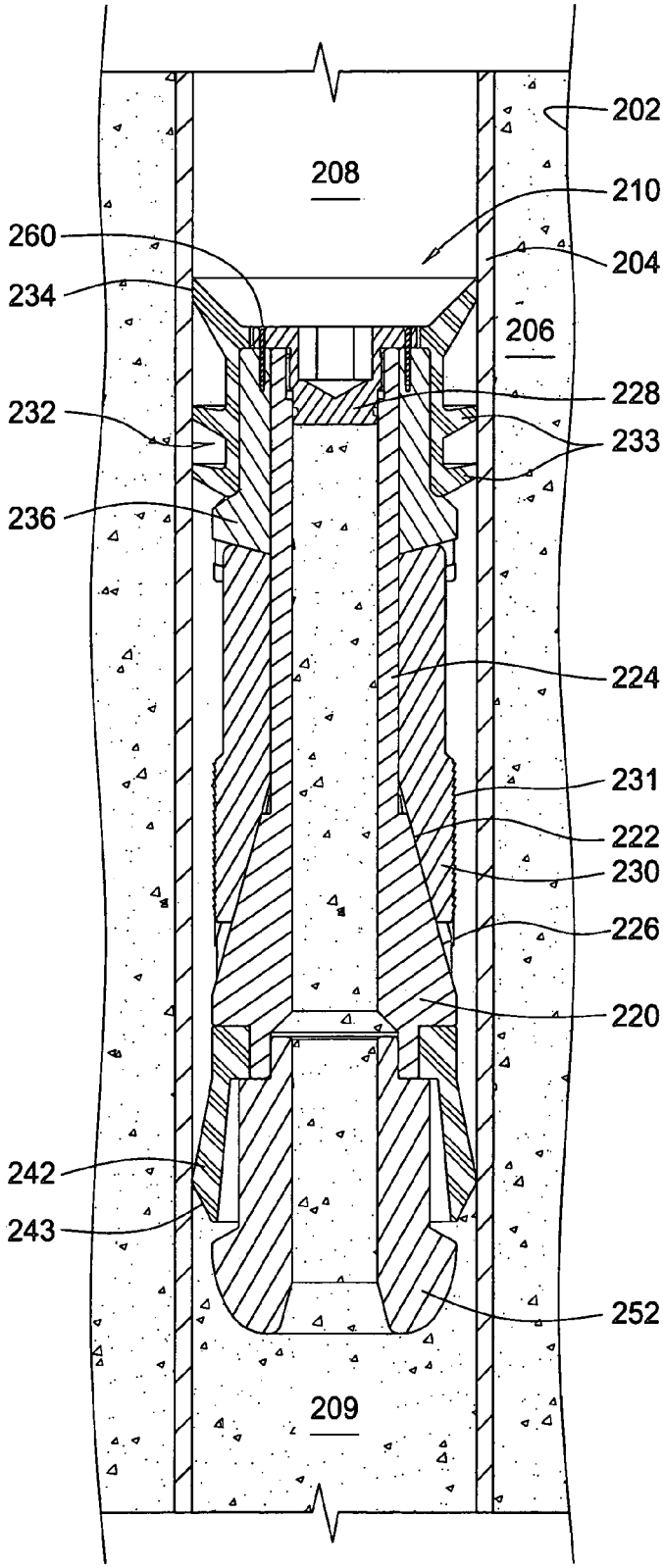
FIG. 5 is a schematic cross-sectional view of the single-direction plug of FIG. 4 in an unactuated position.

FIG. 4 is a schematic perspective view of another embodiment of a single-direction plug 210. The single-direction plug 210 may include a cylindrical body 220 (FIG. 5), gripping members 230, a drag element 232, a sealing member 242, and an end cap 252. FIG. 5 is a schematic cross-sectional view of the single-direction plug 210 of FIG. 4 in an unactuated position disposed within a casing 204 lining a portion of the wellbore 202. The annulus 206 between the casing 204 and the wellbore 202 may be filled with a fluid, such as a cement slurry, or may be unfilled. The plug 210 may separate a first fluid 209, such as a cement slurry, from a second fluid 208, such as a displacement fluid, within the casing 204. The plug 210 is described in greater detail below using terms designating orientation. These terms designating orientation are only used for clarity reasons in reference to the vertical wellbore 202 and should not be deemed to limit the scope of the present invention. In other embodiments, the plug 210 may be disposed in a non-vertical wellbore, such as a horizontal wellbore.

The cylindrical body 220 includes a bore seal 228 to prevent the flow of fluid through the body 220. A bottom end cap 252 may be coupled to the bottom end of the body 220. The end cap 252 may comprise a rounded surface to help direct the plug through the casing 204. A bottom sealing member 242 may be coupled to the bottom end of the body 220. The sealing member 242 comprises a lip 243 which makes slideable contact with the inner walls of the casing 204. The lip 243 of the bottom sealing member 242 is directed downward to help isolate the first fluid 209 below the plug 210. The lip 243 preferably comprises an elastic material. The body 220 may comprise an integral piece or multiple pieces.

The body 220 of the plug 210 further comprises a sloped portion 222 having a narrow region 224 above a wide region 226. The gripping members 230 are disposed around the sloped portion 222 of the body 220 and are moveable axially between the narrow region 224 and the wide region 226 of the sloped portion 222 of the body 220. The gripping members 230 may comprise multiple components as shown in FIG. 4. Referring again to FIG. 5, the gripping members 230 are disposed in a first set of t-shaped dovetail grooves in the slideable sleeve 236 and are disposed in a second set of t-shaped dovetail grooves in the body 220.

In the figure, the drag element 232 comprises fins 233 and lip 234 coupled to the slideable sleeve 236. The lip 234 of drag element 232 acts as a sealing device and helps to isolate the second fluid 208 above the plug 210. Other drag elements 232 may also be used. As the plug 210 is directed down the wellbore 202, the drag element 232 drags against the inner walls of the casing 204 and urges the slideable sleeve 236 upward relative to the body 220. Since the gripping members 230 are disposed in the grooves of the slideable sleeve 236, the gripping members 230 are also urged upward relative to the body 220 to the narrow region 224 of the sloped portion 222 of the body 220. Since the gripping members 230 are at the narrow region 224 of the sloped portion 222 of the body 220, the gripping members 230 are prevented from making contact with the inner walls of the casing 204. In other words, the gripping members 230 are in a retracted position, and, thus, do not hinder downward movement of the plug 210 through the casing 204.

Figure 6:
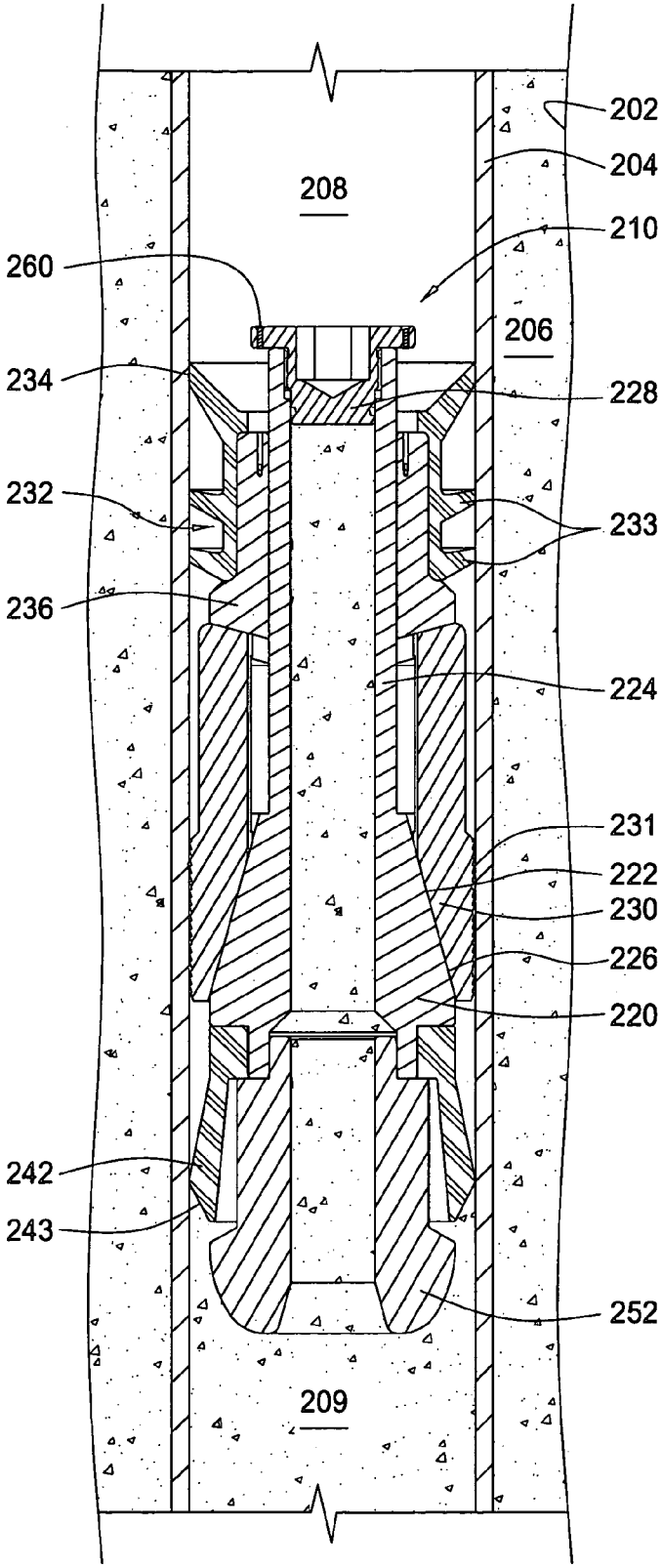
FIG. 6 is a schematic cross-sectional view of the single-direction plug of FIG. 4 in an actuated position.

FIG. 6 is a schematic cross-sectional view of the single-direction plug 210 of FIG. 4 in an actuated position. As the plug 210 is directed up the casing 204, the drag element 232 drags against the inner walls of the casing 204 and urges the slideable sleeve 236 downward. Since the gripping members 230 are disposed in the grooves of the slideable sleeve 236, the gripping members 230 are also urged downward relative to the body 220. As a consequence, the gripping members 230 are urged to the wide region 226 of the sloped portion 222 of the body 220. Due to the larger outer diameter of the wide region 226 of the sloped portion 222 of the body 220, the gripping members 230 are also urged outward from the grooves of the slideable sleeve 236 and the body 220 to make contact with the inner walls of the casing 204, and may become wedged thereagainst. In other words, the gripping members 230 are in an expanded position, and thus, help prevent upward movement of the plug 210 through the casing 204. The gripping members 230 may further comprise gripping elements 231, such as teeth, bumps, or other non-smooth surfaces, to help prevent movement of the plug 210.

Tension pins 260 preventing movement of the slideable sleeve 236 relative to the body 220 may be used to prevent movement of the gripping members 230 during handling at the well surface or may prevent premature setting of the gripping members 230 during run in. For example, a tension pin 260 may be disposed in the top of the body 220 and in the slideable sleeve 236 as shown in FIG. 5. The tension pins 260 can be broken by exposing the plug 210 to a sufficient upward force against the body 220.

In another aspect, the single-direction plug may be launched from a conventional plug container or as a sub-surface release type plug. Examples of sub-surface release type plugs are disclosed in U.S. Pat. No. 5,843,157, which is hereby incorporated by reference in its entirety to the extent not inconsistent with the present disclosure. In one aspect, less time is employed in using a single-direction plug in comparison to a latch-in check valve which is typically pumped down the casing prior to use, such as prior to beginning a cementing process.

Single-direction plugs according to aspects of the present invention may be made of any suitable material, such as polymers, composites, elastomers, plastomers, fiber reinforced materials, metals, alloys, or combinations thereof. The plugs or portions thereof may also be made of wood or wood product such as plywood, or plastics such as thermo set or compression set. Preferably, the plugs are made of a drillable or millable material, comprising a single substance or a composite material, which may be drilled by any industry known drill bit so that the plug may be drilled out and further operations be performed down the wellbore. Additionally, the gripping members 130 and the gripping elements 131 may comprise a single material, such as, but not limited to, cast iron, aluminum, or a ceramic material, or they may comprise a composite material, such as, but not limited to, an engineering grade plastic. Additionally, the embodiment wherein gripping members 130 and/or the gripping elements 131 comprise aluminum may further comprise aluminum with a hard, anodized or other surface coating.

A single-direction plug according to aspects of the present invention may be used in a variety of applications. In one embodiment, a single-direction plug may be used to separate cement slurry and displacement fluid used to pump the cement slurry down a casing and up the annulus. If the plug is exposed to a greater pressure below the plug (i.e. the pressure of the cement slurry below the plug is greater than the pressure of the displacement fluid above the plug), the gripping members 130 or 230 of the plugs 110 or 210, respectively, will be actuated to prevent movement of the plug up the casing. In this respect, the plugs are also known as one-way traveling plugs or unidirectional plugs. The gripping members 130 or 230 of the plugs 110 or 210, respectively, may be actuated at any desired location in the casing by exposing the plug to a greater pressure below the plug. Further, the plug may be actuated and de-actuated multiple times within the wellbore by controlling the pressure of the displacement fluid above the plug. Additionally, the location of the plug in the casing may be ascertained and controlled by means well known within the relevant art, such as the use of a radio frequency identification device (RFID), as generally described in U.S. Pat. No. 3,054,100, which is hereby incorporated by reference in its entirety to the extent not inconsistent with the present disclosure.

Figure 7:
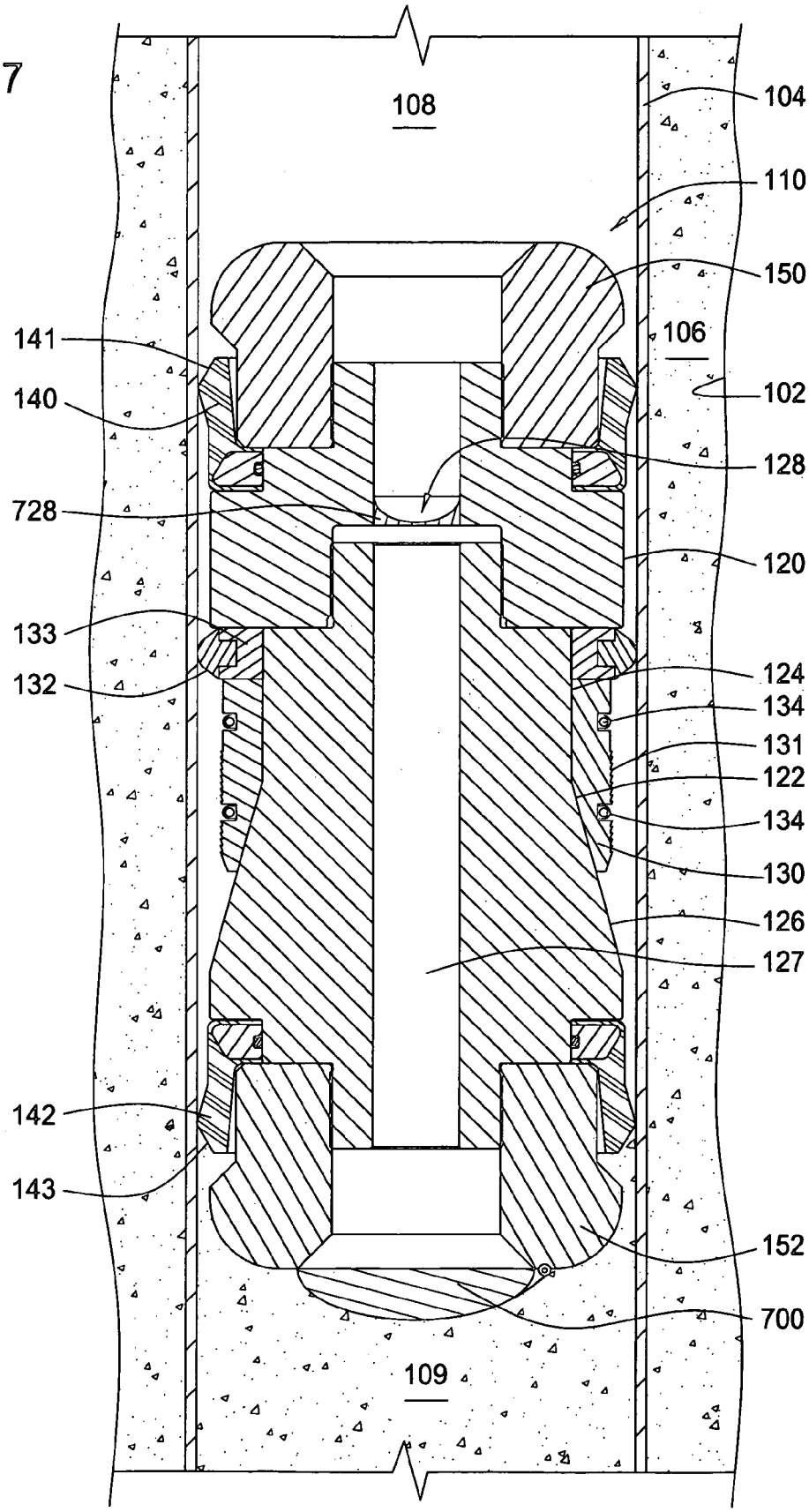
FIG. 7 is a schematic cross-sectional view of another embodiment of a single direction plug according to aspects of the present invention in an unactuated position.

FIG. 7 is a schematic cross-sectional view of another embodiment of a single direction plug in an unactuated position according to aspects of the present invention. The plug is provided with a seal 128 comprising a shearable member 728, such as a rupture disc or shearable membrane. As shown, the shearable member 728 is disposed at the top portion of the plug, however, such positioning is not a limitation of the invention and the shearable member 728 may be disposed at any location along the length of bore 127. The shearable member 728 may be constructed to selectively allow the fluid to pass through the body 120. Preferably, the shearable member 728 is constructed to shear or break at a predetermined pressure. Additionally, the single-direction plug 110 may include a valve 700 to control fluid flow through the bore 127 of the body 120.

Figure 8:
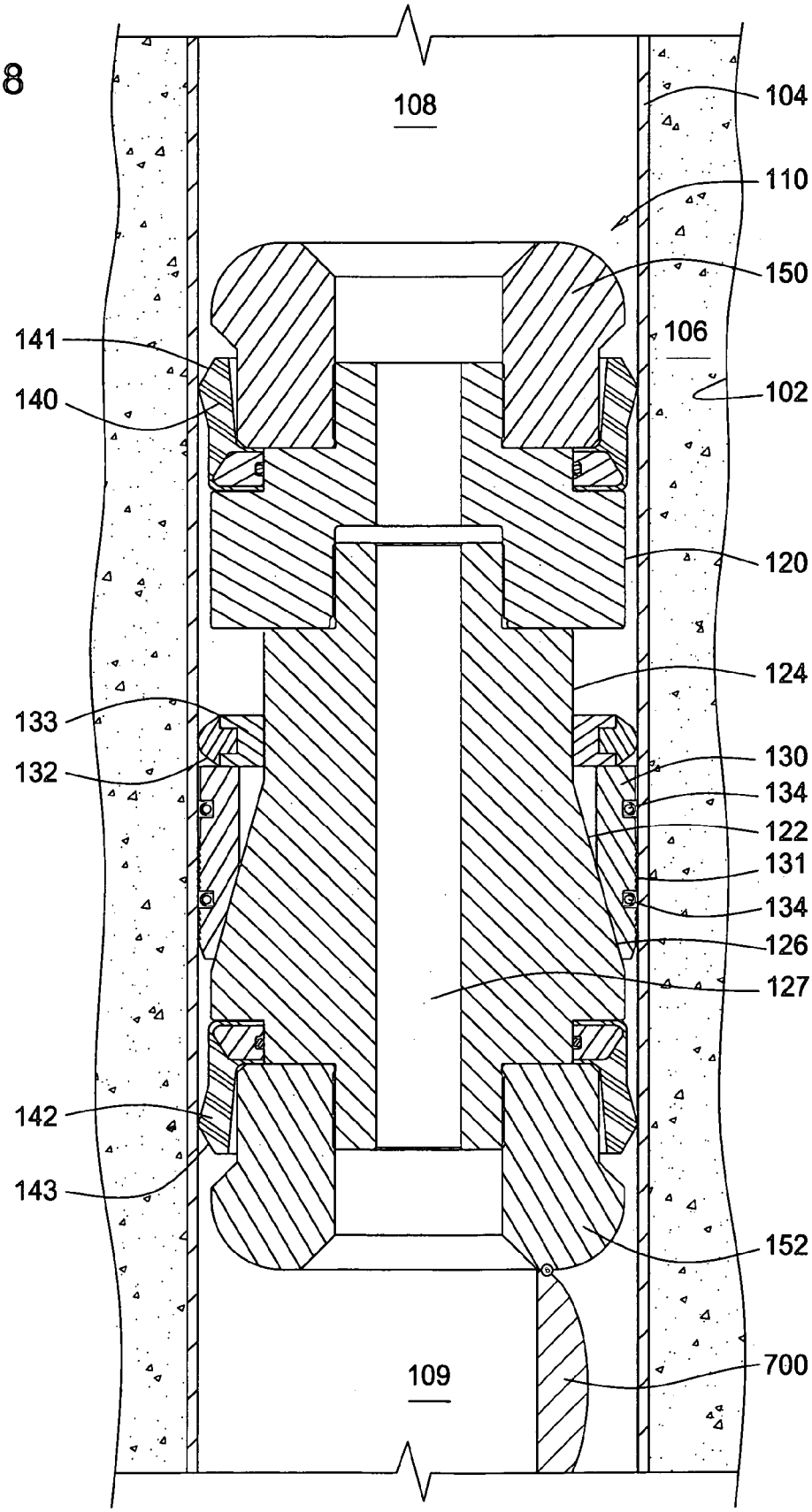
FIG. 8 is a schematic cross-sectional view of the single direction plug of FIG. 7 in an actuated position.

FIG. 8 is a schematic cross-sectional view of the single direction plug of FIG. 7 in an actuated position. As illustrated therein, once the plug 110 has reached a desired location and the plug is set, fluid pressure from above may be applied to rupture the shearable member 728, thereby allowing fluid to pass through the plug 110. In another embodiment, the plug 110 may include bi-directional gripping members such as those shown in FIG. 14. In this manner, the plug 110 may be set in the casing such that it will not move in either direction.

In another aspect, when the plug 110 remains in one location, opening the valve 700 allows the fluid to pass through the plug 110. The valve 700 may be a single direction valve such as a flapper valve. In this respect, the flapper valve may act as a check valve and keep the fluid pumped through the plug from flowing back through the plug. Furthermore, the flapper valve 700 may be adapted to allow movement of the plug 700 once the flapper valve 700 is closed. In this respect, the flapper valve 700 may function as the seal 128, or the shearable member 728, thereby allowing the plug 110 to once again move in a single direction as dictated by the fluid pressure in the casing 104. The plug 110 may continue to travel in one direction until a desired depth is reached and the gripping members are set to prevent axial movement of the plug.

The single-direction plug may also be used in other applications besides cementing operations. Additionally, it can be actuated by means other than those previously described. For example, using a combination of a timer and a gauge to measure hydrostatic head, the device can be made to actuate at a specific depth in the wellbore. By requiring that time and pressure conditions be met, chances of the device prematurely activating are reduced. Preferably, when the time and pressure conditions are met, a pressure chamber within the device can provide force to mechanically set the slips and lock the device axially in the wellbore. In another alternative, a frangible member, like a rupture disk can be utilized. The rupture disk, designed to rupture at a particular depth, could permit pressurized fluid pressurized by hydrostatic head to enter an air of vacuum chamber and provide setting force for the slips. Finally, the device can be made whereby the gripping members are bi-directional slips that prevent movement in either axial direction. In this embodiment, the device could be used as a bridge plug in a plug and abandon operation where cement is permanently left in the interior of a wellbore to prevent migration of fluids towards the surface of an abandoned well. The device may also be used as a pump down cement retainer, float valve, or other suitable downhole apparatus as is known to a person of ordinary skill in the art.

Figure 9:
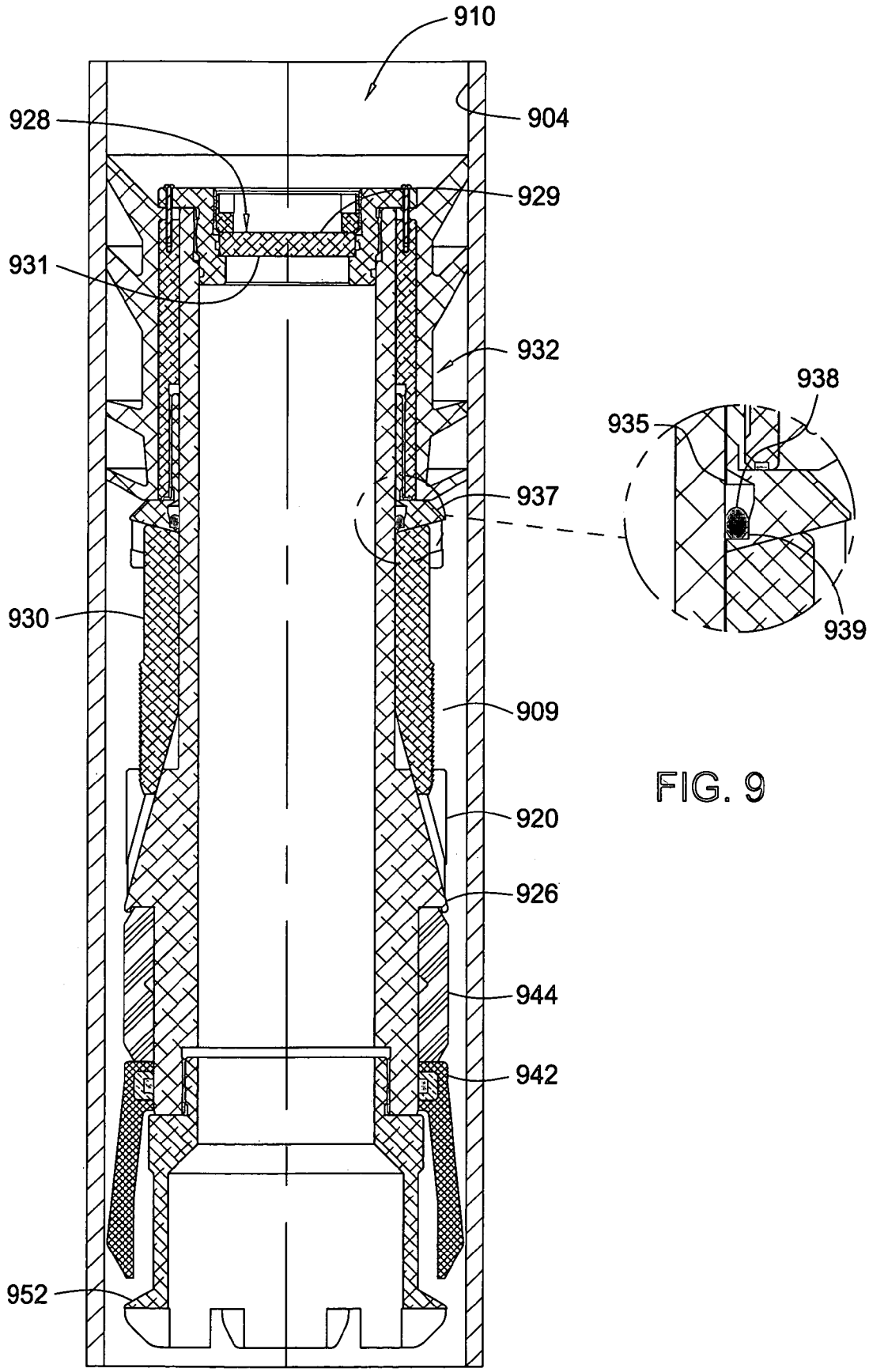
FIG. 9 is a schematic cross-sectional view of another embodiment of a single direction plug according to aspects of the present invention in an unactuated position.
Figure 10:
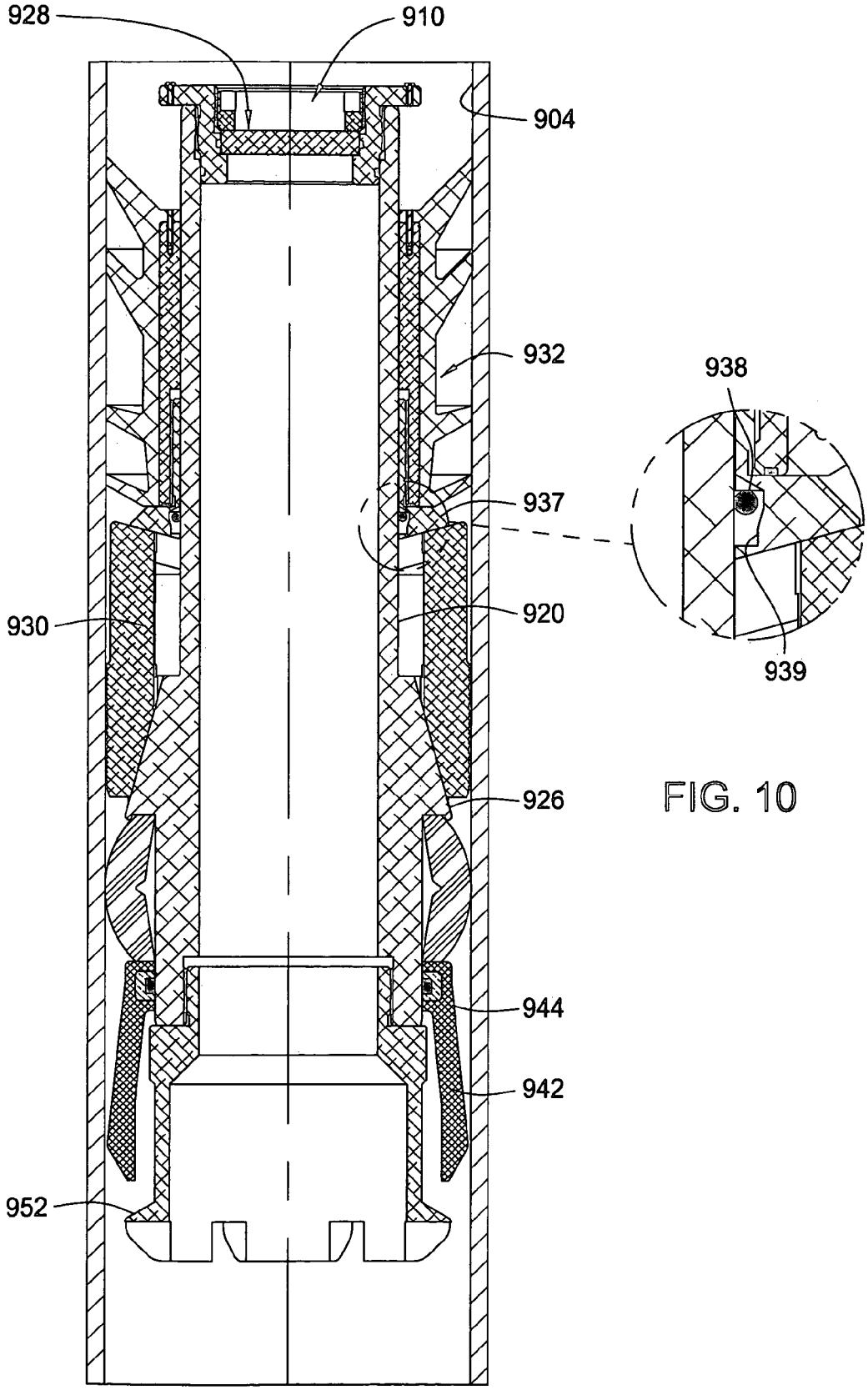
FIG. 10 is a schematic cross-sectional view of the single direction plug of FIG. 9 in an actuated position.

FIG. 9 is a schematic cross-sectional view of another embodiment of a single-direction plug 910 in an unactuated position. As shown, a flow device 937 is disposed below the drag element 932. The flow device 937 includes an opening 935 whereby compressed fluid contained within the area 909 between the cylindrical body 920 and the casing 904 may be selectively released into the casing 904 above the plug 910. Preferably, the flow device 937 only allows unidirectional flow to prevent undesired flow in the reverse direction; that is, flowing back into the area 909 between the cylindrical body 920 and the casing 904. This flow device 937 may comprise a check valve, a displaceable o-ring seal, or any other suitable unidirectional flow device. Preferably, the flow device 937 is actuated by pressure and opens when the pressure in the area 909 between the cylindrical body 920 and the casing 904 exceeds the pressure above the plug 910. In one embodiment, the flow device 937 comprises an o-ring as illustrated in FIGS. 9 and 10. In the unactuated position, the pressure above the plug 910 forces the o-ring 938 into the o-ring seat 939, thereby closing off the flow device 937.

FIG. 10 is a schematic cross-sectional view of the single-direction plug 910 of FIG. 9 in an actuated position. As the plug 910 is directed up the casing 904, the gripping members 930 are urged outward into engagement with the casing 904. Additionally, the area 909 between the cylindrical body 920 and the casing 904 decreases in size, thereby increasing the pressure in the area 909. The increase in pressure causes the flow device 937 to actuate, specifically, the pressure forces the o-ring 938 to be displaced from the o-ring seat 939. In turn, the flow device 937 is opened to allow fluid in the area 909 to release into the casing 904 above the plug 910.

In another embodiment, a sealing element 944 may be disposed at the upper end of sealing member 942, abutting a notched section of wide region 926 of body 920, as illustrated in FIG. 9. The sealing element 944 preferably comprises a flexible material, such as an elastic material. When the pressure of the fluid below the plug 910 increases, the sealing member 942 is caused to move upward. In turn, sealing element 944 is compressed between the sealing member 942 and the abutment, thereby forcing the sealing element 944 to bend outward into contact with the casing 904, as shown in FIG. 10.

In another aspect, the shearable member 928 may be adapted to shear or break at two different pressures. For example, shearable member 928, may comprise a top surface 929, having a surface area $A_t$, which is in contact with the fluid above the plug 910, and a bottom surface 931, having a surface area $A_b$, which is in contact with the fluid below the plug 910. As shown, the surface area $A_t$ of the top surface 929 is smaller than the surface area $A_b$ of the bottom surface 931, as illustrated in FIGS. 9 and 10. Due to the difference in size between $A_t$ and $A_b$, shearable member 928 is shearable by two different pressures. Specifically, the shearable member 928 is adapted to shear or break at a lower pressure exerted against top surface 929, while a greater pressure exerted against the bottom surface 931 is required to shear the shearable member 928 from below the plug 910.

Figure 11:
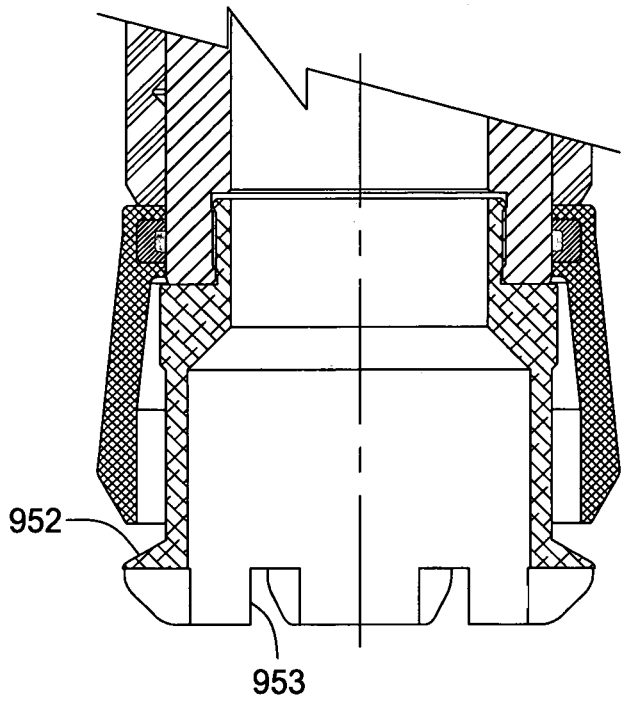
FIG. 11 is a partial schematic cross-sectional view of another embodiment of a single-direction plug according to aspects of the present invention.
Figure 12:
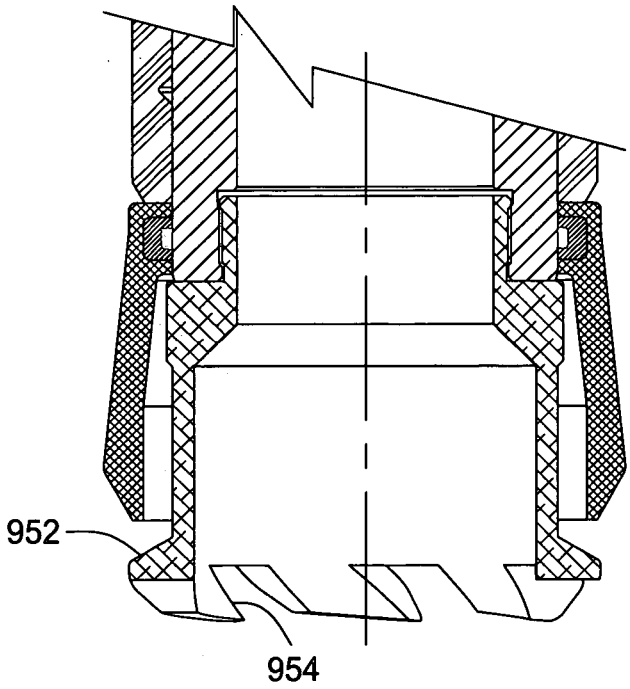
FIG. 12 is a partial schematic cross-sectional view of another embodiment of a single-direction plug according to aspects of the present invention.

In another embodiment, the end caps 952 may further comprise castellations 953 disposed in various sections of the end cap surface, as illustrated in FIG. 11. The castellations 953 serve to improve contact with the bottom of the wellbore and/or cement set below the plug 910 and prevent rotation of the plug 910 which might be caused, for example, by contact with the drill bit when the plug 910 is being drilled out. In a further embodiment, the castellations 954 are disposed at an angle not parallel to the long axis of the plug 910, as illustrated in FIG. 12. It is contemplated that the castellations may be any suitable shape as is known to a person of ordinary skill in the art.

Figure 13:
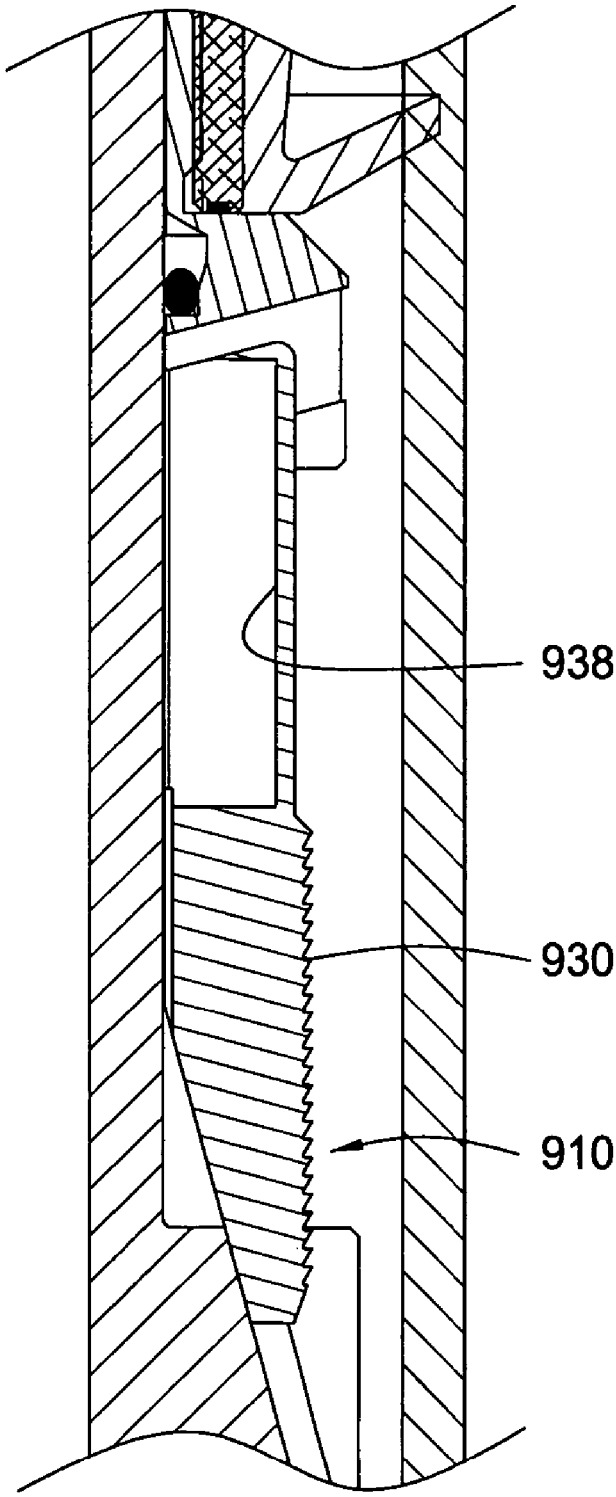
FIG. 13 is a partial schematic cross-sectional view of another embodiment of a single-direction plug according to aspects of the present invention.

FIG. 13 is a schematic cross-sectional view of another embodiment of a single-direction plug 910. In this embodiment, gripping members 930 may comprise a hollowed-out section 938 disposed in a non-loading portion of the gripping members 930. In this respect, a smaller amount of material is required to be drilled out and removed to facilitate the drilling out of the plug 910.

Figure 14:
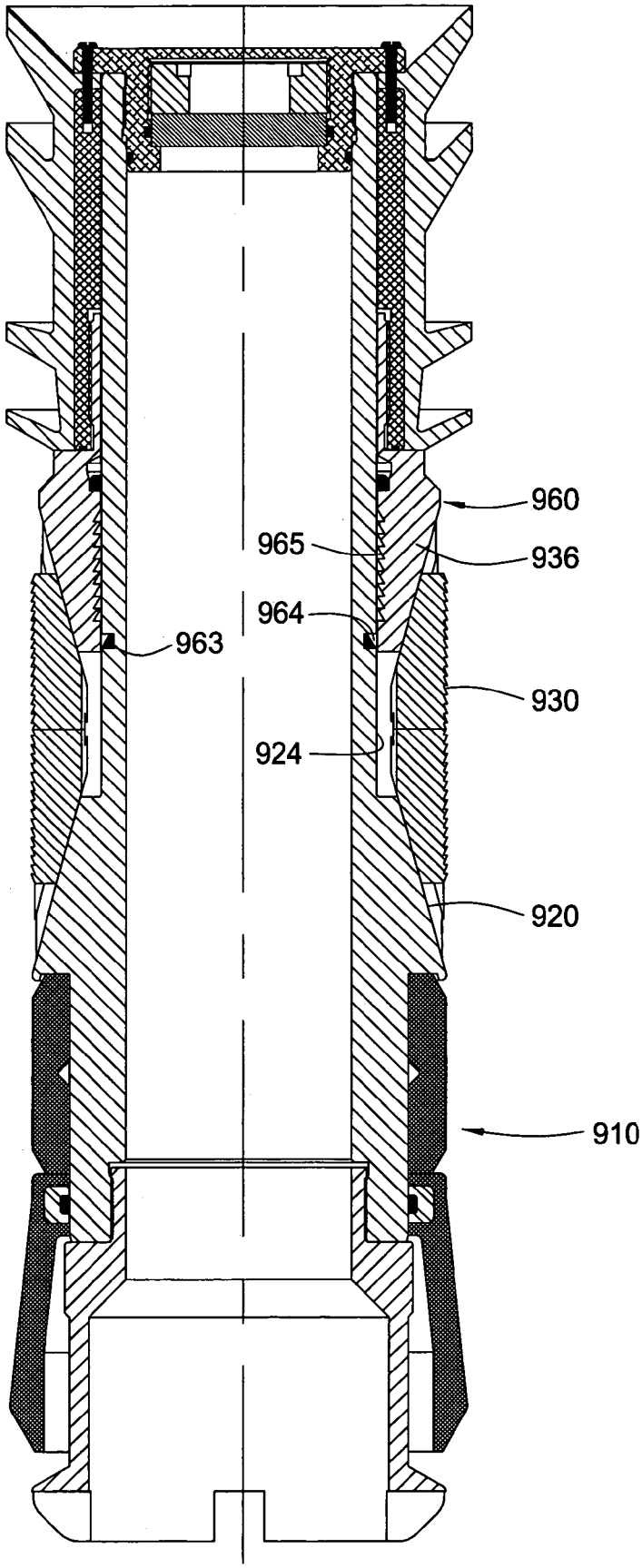
FIG. 14 is a schematic cross-sectional view of another embodiment of a single-direction plug according to aspects of the present invention.

FIG. 14 is a schematic cross-sectional view of another embodiment of a single-direction plug. In this embodiment, a ratchet mechanism 960 is employed wherein snap ring 963 disposed on the narrow region 924 of the body 920 is situated to engage notches 965 disposed on the inner surface of the slideable sleeve 936 when the plug 910 is in an actuated position. In this embodiment, the ratchet mechanism 960 prevents the gripping members 930 from retracting after engaging the casing. Once the ratchet mechanism 960 is set, the plug 910 may be employed as a bridge plug, landing surface for plugs, regular float valve, or any other suitable application known to a person of ordinary skill in the art.

In another aspect, the single-direction plug may be inserted into the casing after the casing has been run in the wellbore. In this respect, the inner bore of the casing is not obstructed, and therefore, pressure surge problems are avoided. Furthermore, as the plug may be positioned at any location in the casing, a float collar or shoe, as was heretofore necessary using existing technology to secure the plug in a desired position, is not required. Once a casing is properly positioned and ready for cementing, a plug 110 or 210 may be released into the wellbore. The plug 110 or 210 may be caused to stop at any desired location therein to regulate the flow of cement.

Figure 15:
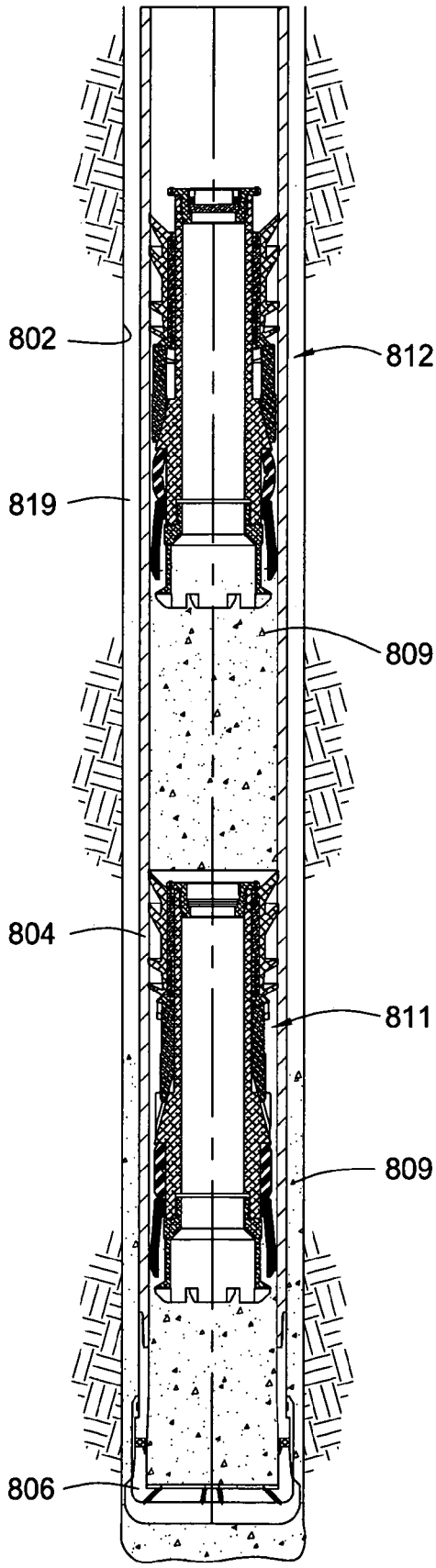
FIG. 15 is a schematic view of single-directions plugs used in a drilling with casing application.

In another embodiment, the single-direction plug may be used to facilitate cementing in drilling with casing applications. For example, referring to FIG. 15, the casing string 804, with a drill bit 806 attached at one end, may be used to drill a wellbore 802 by pumping drilling fluid therethrough. After the hole has been drilled to a desired depth, the casing string 804 remains in the wellbore 802 and is cemented in the wellbore 802. During the cementing operation, a first plug 811 may be used to separate the drilling fluid and the cement 809 as the cement 809 is pumped into the casing 804. At the desired depth, the first plug 811 may be actuated to position itself in the wellbore 802. Thereafter, pressure above the first plug 811 may be increased to break the shearable membrane in the first plug 811 to allow cement 809 to pass through.

Additionally, a second plug 812 may be disposed in the casing 804 to separate the cement 809 and the fluid for urging the cement 809 downward. As shown, the shearable member of the second plug 812 remains in tact to separate the fluids. It can also be seen that some of the cement 809 has been displaced into the annular area 819 between the wellbore 802 and the casing 804. In addition to separating the fluids, the second plug 812 prevents the cement 809 in the annular area 819 from returning into the casing 804. After a sufficient amount of cement has been displaced into the annular area 819, the second plug 812 may be actuated to position itself in the wellbore 802. Specifically, a pressure differential is created such that the pressure above the second plug 812 is less than the pressure below the second plug 812. In turn, the gripping members of the second plug 812 are actuated to engage the casing 804, thereby maintaining its position in the wellbore 802 and preventing cement 809 from flowing back into the casing 804. It must be noted, either one or both of the plugs 811, 812 may be a single directional plug. The use of single direction plugs advantageously allows drilling with casing to be performed without the need of float equipment. Additionally, because such a single direction plug is disposed in the casing after the drilling operation, the plug is not exposed to the drilling fluid, and thus, is not degraded or damaged by drilling fluid.

In still another embodiment, a single-direction plug may be used to advantage with other plugs. For example, a cement slurry may be pumped down the casing with a latch-in bottom plug inserted into the casing prior to the cement slurry and with a single-direction top plug inserted after the cement slurry. The latch-in bottom plug may latch into a collar positioned near the bottom of the casing string. The bottom plug may include a fractable member to allow the cement slurry to pass therethrough. When the single-direction top plug is pumped down to the bottom plug, the bottom plug acts as a stop which prevents further downward movement of the single-direction top plug. It must be noted that the single-direction plug may also be employed as the top plug, bottom plug, or both.

Aspects of the present invention may also be applied to a tool traveling in a fluid conduit. In one embodiment, the tool may be equipped with a gripping member. The tool is disposed in the fluid conduit and caused to travel in a first direction. Thereafter, the gripping members may be actuated to engage a wall of the fluid conduit at a desired location, thereby preventing movement of the tool in a second direction within the fluid conduit. Preferably, the fluid conduit comprises a hydrocarbon conduit such as a wellbore, a pipeline, or a casing. In one embodiment, the tool comprises a downhole tool, which may be released to travel in a first axial direction in the casing. Thereafter, the downhole tool may be caused to grip the casing, thereby preventing the downhole tool to travel in a second axial direction. In another aspect, the tool may be used to separate two fluid bodies in the fluid conduit. Exemplary fluid bodies include cement, drilling fluid, hydrocarbon, and combinations thereof.

While the foregoing is directed to embodiments of the present invention, other and further embodiments of the invention may be devised without departing from the basic scope thereof, and the scope thereof is determined by the claims that follow.

We claim:

1. A method of completing a wellbore, comprising:

positioning a tubular having a drilling member in the wellbore;

disposing a one-way traveling plug in the tubular;

engaging the tubular with a gripping member on the one-way traveling plug; and locating cement in an annular area between the tubular and the wellbore.

2. The method of claim 1, further comprising forming the wellbore.

3. The method of claim 1, further comprising using the plug to separate the cement and another fluid in the wellbore.

4. The method of claim 1, further comprising preventing cement in the annular area from flowing into the tubular.

5. The method of claim 1, wherein the tubular comprises a casing.

6. The method of claim 1, wherein actuating the plug comprises providing a pressure differential in the wellbore.

7. The method of claim 1, further comprising drilling through the plug.

8. The method of claim 7, wherein drilling through the plug is accomplished using a second tubular having a drilling member disposed thereon.

9. The method of claim 1, wherein the gripping member, when actuated, prevent movement of the body in a first axial direction relative to the tubular, and, when not actuated, allow movement of the body in a second axial direction relative to the tubular.

10. The method of claim 1, wherein the gripping member is actuatable by fluid pressure.

11. The method of claim 1, wherein the plug further comprises a sealing member for sealing a fluid path between the body and the tubular.

12. The method of claim 1, wherein the body defines a bore extending therethrough.

13. The method of claim 12, wherein the plug further comprises a seal for sealing the bore.

14. The method of claim 13, wherein the seal is selectively shearable.

15. The method of claim 14, wherein the selectively shearable sealing member comprises a first surface having a first surface area and a second surface having a second surface area, wherein the first surface area is smaller than a second surface area such that the sealing member is shearable by two different pressures.

16. The method of claim 12, wherein the plug further comprises a second sealing member for sealing a fluid path between the body and the tubular.

17. The method of claim 1, wherein the body comprises a sloped portion for biasing the gripping members outward into contact with the tubular.

18. The method of claim 17, further comprising a drag element for urging the gripping members along the sloped portion.

19. The method of claim 1, further comprising a drag element for urging the gripping members axially relative to the body.

20. The method of claim 1, further comprising a biasing member disposed around the gripping members.

21. The method of claim 1, wherein the gripping members are radially expandable into contact with the casing.

22. The method of claim 1, further comprising a valve disposed in the body.

23. The method of claim 1, wherein the valve is a single direction valve.

24. The method of claim 1, wherein the plug is selectively positionable within the casing.

25. The method of claim 1, wherein the gripping members and the gripping elements may comprise a material selected from the group consisting of cast iron, aluminum, aluminum with a hard, anodized coating, a ceramic material, a composite material, or combinations thereof.

26. The method of claim 1, wherein the gripping members comprises a hollowed out portion.

27. The method of claim 1, wherein one or more castellations are disposed at a lower portion of the body.

28. A method of installing a cement plug in a casing to cement the casing in a wellbore, comprising:

running the casing into the wellbore; disposing the cement plug in the casing, the cement plug having a body having a bore therethrough;

a gripping member for preventing axial movement of the body; and a shearable seal member for blocking the bore;

measuring a hydrostatic head; and activating the gripping members in response to the measured hydrostatic head to engage the casing, thereby installing the cement plug in the casing.

29. The method of claim 28, further comprising supplying cement in front of the plug and a fluid behind the plug, wherein the plug separates the fluid from the cement.

30. The method of claim 28, wherein activating the gripping members comprises expanding the gripping members into contact with the casing.

31. The method of claim 28, wherein activating the gripping members comprises urging the gripping members outward along a sloped portion of the body.

32. A plug for installation in a casing, the plug comprising:

a body having a bore therein;

one or more gripping members selectively actuatable for positioning the plug in the wellbore;

a shearable seal member disposed in the bore for blocking a fluid flow therethrough; and a valve for controlling fluid flow through the bore.

33. The plug of claim 32, wherein the one or more gripping members grip the casing to prevent movement of the plug in a first axial direction relative to the casing but allow movement of the plug in a second axial direction relative to the casing.

34. The plug of claim 32, wherein the valve comprises a flapper valve.

* * * * *